US010697096B2

(12) United States Patent
Lonati et al.

(10) Patent No.: US 10,697,096 B2
(45) Date of Patent: Jun. 30, 2020

(54) NEEDLE-HOLDING ELEMENT FOR CIRCULAR KNITTING MACHINES

(71) Applicant: SANTONI S.P.A., Brescia (IT)

(72) Inventors: Ettore Lonati, Botticino (IT); Fausto Lonati, Brescia (IT); Andrea Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 277 days.

(21) Appl. No.: 15/535,640

(22) PCT Filed: Dec. 14, 2015

(86) PCT No.: PCT/IB2015/059591
§ 371 (c)(1),
(2) Date: Jun. 13, 2017

(87) PCT Pub. No.: WO2016/097974
PCT Pub. Date: Jun. 23, 2016

(65) Prior Publication Data

US 2017/0350047 A1 Dec. 7, 2017

(30) Foreign Application Priority Data

Dec. 18, 2014 (IT) ..... BS2014A000214

(51) Int. Cl.
*D04B 15/14* (2006.01)
*D04B 35/04* (2006.01)
(Continued)

(52) U.S. Cl.
CPC ..... *D04B 15/14* (2013.01); *D04B 9/06* (2013.01); *D04B 15/322* (2013.01); *D04B 15/34* (2013.01); *D04B 35/04* (2013.01)

(58) Field of Classification Search
CPC ..... D04B 15/14; D04B 15/16; D04B 9/06; D04B 15/34; D04B 15/322; D04B 35/04
(Continued)

(56) References Cited

U.S. PATENT DOCUMENTS 281,804 A * 7/1883 Simonson ..... A47C 23/155 66/8
1,035,656 A 8/1912 Swinglehurst
(Continued)

FOREIGN PATENT DOCUMENTS

WO 2013/041380 A1 3/2013

OTHER PUBLICATIONS

Mar. 1, 2016 Search Report issued in International Patent Applicaton No. PCT/IB2015/059591.
(Continued)

*Primary Examiner* — Danny Worrell
(74) *Attorney, Agent, or Firm* — Oliff PLC

(57) ABSTRACT

A needle-holding element for circular knitting machines, having a structure as a hollow solid of rotation developing around a central axis and configured for rotating and for supporting a plurality of needles moving so as to produce a knitted fabric; the needle-holding element has at least one working surface shaped as a surface of rotation obtained through the rotation of a portion of generating straight line around the central axis; on the working surface a plurality of needle seats is defined, placed one beside the other and arranged circumferentially or radially around the central axis, wherein each needle seat movably houses at least a portion of at least one respective needle. At least one needle seat has at least a first length has a longitudinal development, on the working surface, inclined with respect to the generating straight line.

18 Claims, 9 Drawing Sheets

(51) Int. Cl.
*D04B 15/34* (2006.01)
*D04B 15/32* (2006.01)
*D04B 9/06* (2006.01)

(58) Field of Classification Search
USPC ..... 66/114, 115
See application file for complete search history.

(56) References Cited

U.S. PATENT DOCUMENTS

| | | | | | |
|---|---|---|---|---|---|
| 1,797,006 | A * | 3/1931 | Lombardi | D04B 15/74 | 66/231 |
| 2,259,384 | A * | 10/1941 | Larkin | D04B 35/22 | 66/115 |
| 2,568,806 | A * | 9/1951 | Henning | D04B 9/44 | 66/115 |
| 3,543,280 | A * | 11/1970 | Greczin | D04B 9/44 | 66/115 |
| 3,977,214 | A | 8/1976 | Greczin | | |
| 2012/0006064 | A1 * | 1/2012 | Haug | D04B 15/14 | 66/115 |

OTHER PUBLICATIONS

Mar. 1, 2016 Written Opinion issued in International Patent Application No. PCT/IB2015/059591.

* cited by examiner

FIG.2
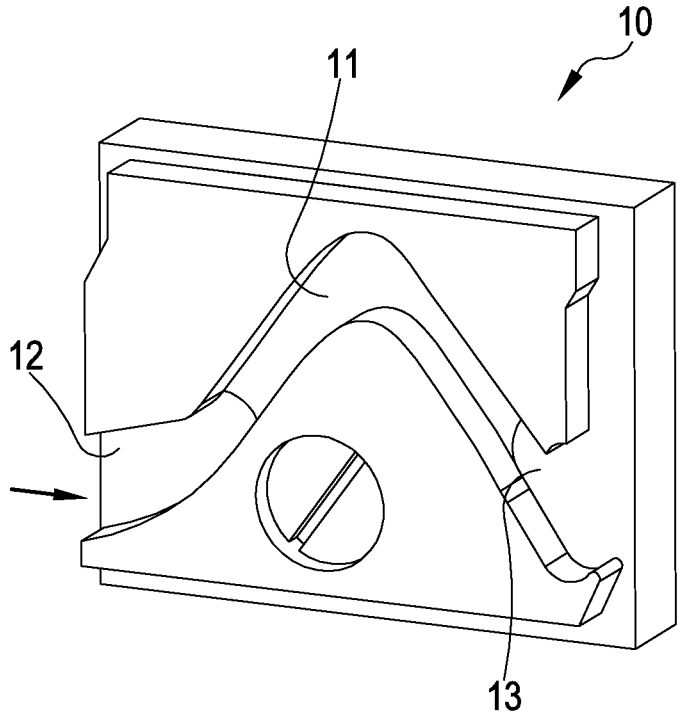
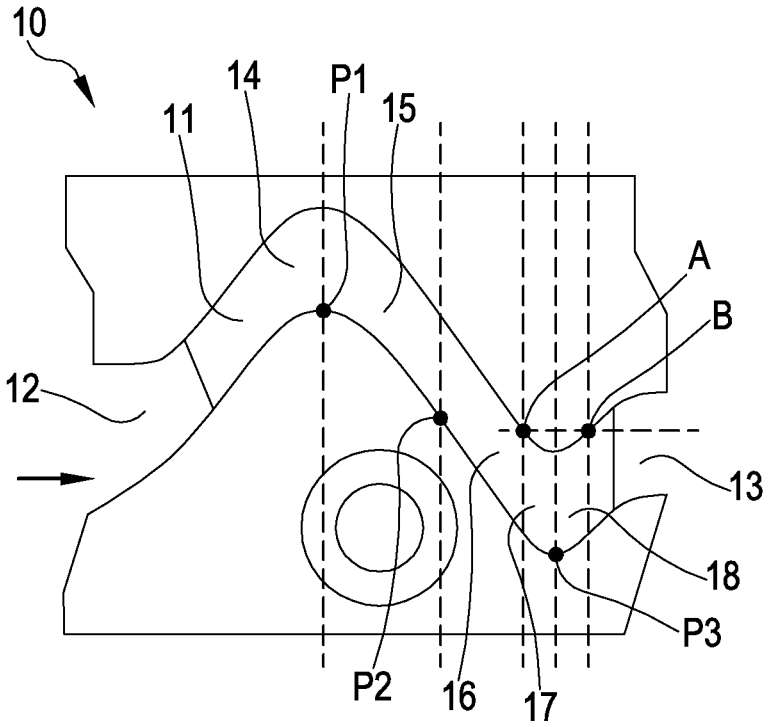
FIG.3

NEEDLE-HOLDING ELEMENT FOR CIRCULAR KNITTING MACHINES

The present invention relates to a needle-holding element for a circular knitting machine and to a circular knitting machine comprising this element.

In particular, the present invention relates to a needle-holding cylinder or a needle-holding plate designed to be introduced into a knitting machine and characterized by a specific structure of its seats apt to house the needles of the knitting machine. The present invention can further relate to a circular knitting machine comprising a needle-holding element, having a specific structure, and further components such as control elements, needles, etc.

The present invention falls into the technical field of circular knitting machines for knitted items, seamless knitted items, hosiery items and the like.

In the present text the word "knitting machine" generally means a circular knitting machines apt to manufacture knitted items and provided with at least one needle-holding element, i.e. with a needle-holding cylinder or plate, turnably mounted in a frame of the machine and supporting a plurality of needles moving so as to produce a knitted fabric. Moreover, the knitting machine is provided with a plurality of yarn feeding points or yarn "feeds", in which the needles of the machine are supplied with yarn. This knitting machine can be e.g. single or double needlebed. Circular knitting machines can comprise a variable number of feeds, e.g. 4, 6, 8 or more yarn feeds. As is known, circular knitting machines for knitted items are provided with stitch forming elements generally comprising: a needle-holding cylinder and/or a needle-holding plate, actuating cams, needles, etc.

The knitted fabric is produced by rotating the needle-holding cylinder and/or the needle-holding plate around an axis of rotation.

As far as the needle-holding cylinder is concerned, the needles are arranged vertically on the outer surface of the cylinder, in dedicated seats suitably shaped to house them. Conversely, as far as the needle-holding plate is concerned, the needles are inserted onto the upper face thereof, in seats having a radial direction with respect to the axis of rotation of the knitting machine. The sliding direction of the needles corresponds to a straight line along which the motion of the needles working inside the respective seat occurs: this sliding direction is vertical and parallel to the axis of rotation of the machine for needles belonging to the cylinder, whereas it is horizontal and radial with respect to the axis of rotation of the machine for the needles belonging to the plate.

FIG. 1 schematically shows a needle-holding cylinder C and a needle-holding plate P, with their respective sliding directions (V for cylinder needles and R for the plate needles); moreover, X designates the axis of rotation of the knitting machine. The needle seats, both of the cylinder and of the plate, are represented—for simpleness' sake—for an angular portion of the cylinder and of the plate only.

In order to move the needles along the respective sliding direction, cams (referred to as "stitch cams" are used, provided with a profile that is able to interact with suitable needle butts so as to control the movement of the needles in the respective needle seat. This movement occurs at least from a first position, in which the produced stitch gets under the needle latch, to a second position, in which the needle—after taking the yarn—gets under the holding-down plane for forming new knitted fabric.

In order to understand the interaction between the needle butts and the control cams, FIGS. 2 and 3 show in an exemplary and schematic manner the typical shape of a stitch cam, which enables precisely to make conventional knitted stitches. The butt of a needle getting inside the "path" defined by the stitch cam makes the needle move between the aforesaid first and second position for making knitted stitches. For simplicity's sake it is assumed that the stitch cam shown is related to a needle-holding cylinder; however, the operation is the same for the needles of a plate.

FIG. 2 designates with "P1" the point corresponding to the first position and with "P2" the point corresponding to the second position. Basically, the stitch cam—thanks to its profile—makes the needle rise above the stitch forming plane so that the stitch already produced gets under the needle latch and the needle head takes new yarn, and then sink—with the new yarn—to a level below the holding-down plane.

The total travel of the needle depends on various parameters and highly affects the geometry of the stitch cam. As a matter of fact, in order to obtain a given law of motion for the needle (i.e. a desired movement of the needle, during rotation, along its sliding direction) it is necessary to suitably profile the stitch cam (in which the butts slide).

The stitch cams actuate the needle butts by means of a generally closed "path", i.e. defined above and below, with a angle of pressure varying instant by instant. The wording "angle of pressure" means the angle formed for each point of the stitch cam by the direction of motion of the needle but (i.e. by the horizontal direction imparted by the cylinder rotation) with the inclination or slope on every point of the stitch cam itself (i.e. with the tangent to the cam surface). As an alternative, by convention, the angle of pressure can be considered as the complementary angle to the angle formed by the needle axis and the profile slope, i.e. 90°—angle between needle and cam profile. It is obvious that the steeper the cam profile, the greater the angle of pressure.

Among the various factors affecting the stitch cam shape, one of the most relevant is fineness. The fineness of a knitting machine indicates the pitch between two adjacent needles.

In the stitch forming point, the yarn must not be subjected to too high tensions since otherwise it would be likely to break. See for this FIG. 4, which shows the movement of the needles caused by a portion of the stitch cam, in particular the portion between points A and B in FIG. 2. This portion has an important role since it is the portion on which the stitch is physically formed.

The yarn fed on point T1 (FIG. 1) is pulled by the needles sliding along the profile of the stitch cam and going from point A to point B. On point A the yarn is blocked on the holding-down plane; from this point A onwards the yarn tension progressively increases since the yarn must slide on a greater and greater number of blades of the holding-down plane and of needles, and the feed is partially blocked by the needle in A position. It is known that the needle pulling the yarn subjected to the maximum tension (referred to in FIG. 4 with Tm) is the one just upstream from the point of maximum sinking (referred to with P3). This phenomenon is due to the fact that the needles downstream from the point of maximum sinking which rise partially release the yarn they had pulled from the feed; thus, the lowest needle (which has taken the maximum amount of yarn) is not the one on which the most tensioned yarn lies, since the following needle has partially released the yarn and reduced the tension right of the lowest needle. The needle keeping the most tensioned yarn is—as schematically shown by the arrows in FIG. 4—the one with the maximum tension Tm; thus, the most tensioned yarn is the one contained in the needle preceding the lowest needle; this yarn is blocked on both sides by two needles dragging the yarn. In general, all the needles between point A and point B tension the yarn, which slides by friction on following blades of the stitch plane.

The vertical distance between the stitch forming plane and the point of maximum sinking, referred to in FIG. 4 with letter "d", varies as a function of fineness: as a result, systems for adjusting cams which allow to move them vertically are known. In general, it is not possible to reduce "d" below a given value, since a given sinking "d" is required for ensuring the correct formation of knitted stitches. For instance, in high fineness, single needlebed machines it can be necessary for "d" value to be at least of 0.7-0.8 mm, due to the minimum size that can be obtained for the hooks (or heads) of the needles: as a matter of fact, should the needles not sink below the holding-down plane—by means of the stitch cams—at least of such a value, it would not be possible to cast off the hooks the old stitch and it would not therefore be possible to correctly produce a knitted fabric. Therefore, after defining a minimum "d" distance, as the fineness increases the number of engaging needles increases (i.e. adjacent needles included in the stitch cam between points A and B); that is why the stitch cam profile—from a theoretical point of view—should have an inclination θ (referred to in FIG. 4) which increases as fineness increases (i.e. as the needle pitch, referred to with "a" in FIG. 4, decreases). However, in the field of circular knitting machines it is known that the maximum angle of pressure (θ) currently applicable to a stitch cam, in particular during the sinking step, is of about 55°. Higher values of the pressure value (i.e. higher slopes of the stitch cam) can cause the butts of the moving needles to break, since the high inclination of the cam profile makes it difficult for the needle to slide in its seat due to the friction between needle and seat, which can lead to needle blocking and as a result to butt breaking in the stitch cam. Moreover, the needle butts can sometimes bend and deviate from the vertical line as a result of the applied forces: this bending, if the slope of the stitch cam profile is high, can cause the butt to block inside the cam and therefore to break.

The graph in FIG. 5 shown by way of example the profile of a stitch cam according to known technique; the butts get in from the left side and get out from the right side; the abscissa x represents the horizontal extension of the cam, whereas the ordinate γ shows the vertical height of the profile point by point. FIG. 5 represent two curves: the upper curve is the cam profile, whereas the lower curve is the counter-cam; globally, the two profiles define the path inside which the needle butts slide.

The graph in FIG. 6 shows by way of example the development of the angle of pressure θ in each point x of the stitch cam profile of FIG. 5. It can be seen (observing the dashed straight lines indicating the values +20°, +40°, −20°, −40° that the profile is carried out so as to ensure the absence of discontinuity and at the same time avoid exceeding the critical value of about 55° for the angle of pressure θ, a value above which the needle butts break. It should further be observed in FIG. 6 that the angle of pressure can take negative values, in the portion where the stitch cam is sinking; this is due to the calculation mode of the angle of pressure. The important thing is that as absolute value the angle of pressure does not exceed the limit value of needle break.

In addition to the relation fineness/theoretical inclination of the cams, there is also a relation between the fineness of the knitting machine and the count that can be used for the yarns. As a matter of fact, from the theoretical point of view the yarn subjected to traction by the needles can be assimilated to any other material and as a result the maximum tension that can be tolerated by the yarn does not decrease in a linear manner as the count (i.e. the radius) varies, since—assuming that the yarn has a circular section—the value of tension decreases as a function of the square of the radius (and therefore decreases in a more linear manner), i.e. according to the following relation:

$$Tm=Rm*(\pi Tr*R\hat{}2)$$

where Tm is the maximum tension (force) that can be tolerated by the yarn, Rm is the breaking load of the specific yarn and R is the radius of the theoretical section of the yarn.

In addition, this theoretical calculation does not take into account the fact that generally yarns are not made up of one fiber only, but are multi-fiber; moreover, the fibers of natural yarns (e.g. cotton) are discontinuous and this implies a degradation of the mechanical properties when the yarn slides on the blades of the holding-down plane.

In the most recent years, the market of knitting machines has been requiring higher and higher finenesses, increasing from a maximum fineness value of 30 to a desired value of 90, which means a reduction of the pitch between the needles (a) from 0.85 mm to 0.28 mm.

In a machine with high fineness, the need to ensure a minimum sinking value "d" under the holding-down plane and at the same time the impossibility of having too high a angle of pressure (i.e. the impossibility of sinking from point A with too steep a cam profile) result in the presence, instant by instant, of a large number of needles, all of them lying below the holding-down plane (e.g. as shown in FIG. 7, eight needles for a fineness of 90). The large number of needles involves an increase of tension on the yarns, according to the diagram shown in FIG. 4; as a matter of fact, all the needles between point A and point P3 lead to an increase of tension on the yarn, which slides with friction on the following knitting planes. It is therefore not possible to increase fineness (since the number of needles between point A and point P3 would increase) or the rotational speed of the needle-holding element, since the yarn breaks or loses fibers and it is therefore impossible to produce knitted fabric. In addition, the increase of tension collides with the decrease of the maximum tension that can be tolerated by extremely thin yarns used for high finenesses.

In the light of the above, it is manifest that the production of circular knitting machines with high fineness is particularly complex. Known solutions cannot go beyond given fineness values and reach higher performance, since serious drawbacks occur, such as needle butt breaking and/or yarn breaking.

The Applicant has further verified that known stitch cams typically have a "symmetrical" shape, i.e. they have a rising portion followed by a sinking portion, these two portions having similar slopes (as absolute values) and therefore developing for similar lengths; this is due to the need to limit the angle of pressure in order to avoid too high mechanical efforts. Therefore, basically the length of the stitch cam is substantially divided in equal parts between the rising portion (where the previous stitch is cast off) and the sinking portion (where the new stitch is loaded). However, considering things from the textile point of view (i.e. without taking into account mechanical limitations), it would be desirable to carry out an "asymmetrical" cam, i.e. a cam having a rising portion (i.e. where the old stitch is cast off) with low steepness, followed by a highly steep sinking portion (new stitch loaded) tending to be "vertical". The reason for this is that, as pointed out above, the highest efforts on the yarns occur in the stitch cam portion related to step in which the stitch is created, i.e. during the following sinking to the aforesaid point A as far as point P3 of maximum sinking (see FIG. 4). Therefore, a steep sinking would enable to reduce the number of engaging needles (i.e. engaging the yarn) in the cam portion from point A to point P3 of FIG. 4, and thus to reduce tension on the yarns.

However, as explained above, this is not possible since a steep sinking would have angles of pressure above 55°, which constitutes a mechanical limit above which the needle butts break.

In short, the increase of fineness causes a decrease of the pitch between the needles and therefore an increase of the number of needles between points A and B of the stitch cam: this results in an increase of tension on the yarns. In order to limit this phenomenon, a steep sinking portion should be carried out, but this collides with the mechanical limit of the angle of pressure, or the sinking value "d" should be reduced, but this collides with the minimum limit of "d" to be ensured for a correct vertical travel of the needle heads.

Ultimately, the Applicant has found that known solutions are not without drawbacks and can be improved under various aspects.

Under these circumstances, the aim underlying the present invention in its various aspects and/or embodiments is to provide a needle-holding element for circular knitting machines and a circular knitting machine comprising such an element, which can obviate one or more of the drawbacks referred to above.

Another aim of the present invention is to create alternative solutions to known technique for carrying out needle-holding elements for circular knitting machines and/or open new design possibilities.

Another aim of the present invention is to provide a needle-holding element for circular knitting machine which can enable a new design of the stitch cams cooperating with this element.

Another aim of the present invention is to provide a needle-holding element for circular knitting machine which can open new possibilities for carrying out stitch cams.

Another aim of the present invention is to provide a needle-holding element for circular knitting machines which can enable to increase the performance of a knitting machine, and in particular to increase the fineness of the knitting machine (e.g. up to values of 60, 90 or above).

Another aim of the present invention is to provide a needle-holding element for circular knitting machines characterized by a high operating reliability and/or by a lower susceptibility to failures and malfunctions, in particular for high finenesses and/or for high operating speeds.

Another aim of the present invention is to provide a needle-holding element for circular knitting machines which can enable to reduce or eliminate the breaking of the butts of the needles cooperating with the stitch cams.

Another aim of the present invention is to provide a needle-holding element for circular knitting machines which can enable to reduce or eliminate the breaking of yarns, in particular with high finenesses.

Another aim of the present invention is to provide a needle-holding element for circular knitting machines characterized by a simple and rational structure.

Another aim of the present invention is to provide a needle-holding element for circular knitting machines characterized by an innovative structure and configuration of the needle seats.

Another aim of the present invention is to provide a needle-holding element for circular knitting machines characterized by low manufacturing costs as far as performance and quality offered are concerned.

These and other possible aims, which shall appear better from the following description, are basically achieved by a needle-holding element for circular knitting machines and by a circular knitting machine comprising such an element according to one or more of the appended claims, each one being considered alone (without those depending on it) or in any combination with the other claims, and according to the following aspects and/or embodiments, variously combined, also with the aforesaid claims.

In a first aspect thereof, the invention relates to a needle-holding element for circular knitting machines designed to be movably (turnably) mounted in a frame of a circular knitting machine and having a structure basically as a hollow solid of rotation developing around a central axis, the needle-holding element being configured for rotating around said central axis and for supporting a plurality of needles moving so as to produce a knitted fabric, the needle-holding element having at least a working surface having a shape as a surface of rotation obtained by rotation of a portion of generating straight line around the central axis, wherein on the working surface a plurality of needle seats is defined, placed one beside the other and arranged circumferentially or radially around said central axis, each needle seat being configured for movably housing at least a portion of at least one respective needle of the knitting machine.

In one aspect, at least one needle seat of said plurality of needle seats has at least a first length having a longitudinal development, on said working surface, inclined with respect to the generating straight line.

In one aspect, at least one needle seat of said plurality of needle seats has at least a first length having a longitudinal development, on said working surface, that is not parallel and/or not perpendicular to said central axis.

In one aspect, said generating straight line is parallel to the central axis or is arranged radially with respect to the central axis. In one aspect, said portion of generating straight line is a segment. In one aspect, each needle seat has a main longitudinal development and is configured for laterally containing inside, at least partially, said at least one respective needle, so that the needle can slidably move in the needle seat following said longitudinal development of the seat itself.

In one aspect, the first length is configured for slidably housing at least a portion of a respective needle comprising the butt of the needle itself.

In one aspect, said first length is inclined with respect to a direction parallel or perpendicular to the central axis of the needle-holding element.

In one aspect, said at least one needle seat has a second length transversal with respect to said first length and having a longitudinal development, on said working surface, overlapping said generating straight line.

In one aspect, the second length is configured for slidably housing at least a portion of the respective needle comprising a head of the needle itself.

In one aspect, the first length and the second length of the needle seat are rectilinear and develop in respective directions, said first length and said second length forming together an angle of inclination different from zero.

In one aspect, said angle of inclination is greater than 0° and/or greater than 5° and/or greater than 10° and/or greater than 20° and/or greater than 30° and/or smaller than 90° and/or smaller than 80° and/or smaller than 60°.

In one aspect, the first length and the second length are arranged, on said working surface, so as to define in a continuous manner the main longitudinal development of the respective needle seat.

In one aspect, the first length is at least partially curved and varies point by point said angle of inclination.

In one aspect, the first length of the needle seat is inclined with respect to the second length so as to lie at the back with respect to the second length, along a direction of rotation, during use, of the needle-holding element.

In one aspect, said first length is configured for completely housing at least one respective needle in at least one operating position, i.e. said first length comprises or defines the whole longitudinal development of the needle seat.

In one aspect, the first length of the needle seat, corresponding to the whole needle seat, is rectilinear and develops in a respective unitary direction of development, which is transversal with respect to said generating straight line and lies on the working surface.

In one aspect, said respective unitary direction of development forms with said generating straight line an angle of inclination different from zero.

In one aspect, said needle seat comprises one rectilinear length having one angle of inclination different from zero with respect to said generating straight line, said one rectilinear length corresponding to said first length. In one aspect, said angle of inclination is greater than 0° and/or greater than 5° and/or greater than 10° and/or greater than 20° and/or greater than 30° and/or smaller than 90° and/or smaller than 80° and/or smaller than 60°.

In one aspect, the needle-holding element is a needle-holding cylinder, developing as a solid of rotation around said central axis, said working surface being an outer surface of the needle-holding cylinder having a vertical development and lying on planes parallel to the central axis.

In one aspect, the second length of the needle seat is arranged, on said working surface of the needle-holding cylinder, parallel to the generating straight line or preferably along a direction overlapping the generating straight line.

In one aspect, said first length defining the whole longitudinal development of the needle seat and being configured for completely housing at least one respective needle in at least one operating position, the needle seat has on its whole longitudinal development an angle of inclination, preferably constant, with respect to straight lines (lying on the working surface and) overlapping the generating straight line.

In one aspect, the needle-holding element is a needle-holding plate, developing as a solid of rotation around said central axis, said working surface being an upper surface of the needle-holding plate developing on a plane perpendicular to the central axis.

In one aspect, the second length of the needle seat is arranged, on said working surface of the needle-holding plate, radially and perpendicularly to the central axis.

In one aspect, said first length defining the whole longitudinal development of the needle seat and being configured for completely housing at least one respective needle in at least one operating position, the needle seat has on its whole longitudinal development an angle of inclination, preferably constant, with respect to the generating straight line and/or to straight lines lying on the working surface and arranged radially with respect to the central axis.

In one independent aspect thereof, the present invention relates to a circular knitting machine for knitted or hosiery items, comprising:

a frame;

at least one needle-holding element according to one or more of the preceding aspects, having a structure basically shaped as a hollow solid of rotation developing around a central axis, the needle-holding element being turnably mounted in said frame so as to turn around said central axis;

a plurality of needles movably introduced into the needle seats of the needle-holding element and moving so as to produce a knitted fabric, wherein each needle seat houses at least one respective needle, each needle comprising at least one respective butt and one respective head;

a plurality of needle control devices or "stitch cams", configured for interacting with the needles, in particular with the needle butts, so as to transmit to the needles a given movement inside the respective needle seat during the rotation of the needle-holding element.

In one aspect, each needle, in particular the respective stem, extends between an upper portion, on which the needle head is defined, configured for interacting with the yarns so as to produce a knitted fabric, and a lower portion, on which the needle butt is defined, configured for interacting with said control devices, each needle having a unitary shape in which head and butt are connected continuously and move integrally inside the respective needle seat.

In one aspect, each needle is configured for moving slidably with an alternate motion inside the respective needle seat, following the main longitudinal development of the seat.

In one aspect, the needles are structured for bending so as to follow the longitudinal development of the needle seat, i.e. so as to follow the development of the first length and of the second length of the needle seat.

In one aspect, each needle comprises an intermediate portion of its stem placed between and connecting said upper portion and said lower portion of the needle, said intermediate portion being designed to be placed on an intermediate length of the needle seat and being configured for bending during the sliding of the needle inside the respective needle seat, so that the lower portion of the needle, comprising the butt, can slide with an alternate motion in the first length of the needle seat, and the upper portion of the needle, comprising the head, can slide with an alternate motion in the second length of the needle seat.

In one aspect, said intermediate portion of the needle has a smaller cross section than a cross section of the upper portion of the needle and/or than a cross section of the lower portion of the needle, so that the upper portion and the lower portion can mutually bend during the alternate motion of the needle in the respective needle seat.

In one aspect, the intermediate portion of the needle has a relief or discharge on which the lower portion of the needle is bent with respect to the upper portion of the needle to an extent corresponding to the angle of inclination between the first length and the second length of the needle seat.

Preferably, the intermediate portion is elastic or flexible.

In one aspect, the needle slides inside the needle seat by means of a composite movement of the needle itself, wherein the upper portion of the needle shifts along the direction of development of the second length of the needle seat, the lower portion of the needle shifts along the respective direction of development of the first length of the needle seat, and the intermediate portion of the needle moves with successive bending movements in the intermediate length of the needle seat, alternately towards said first length and towards said second length.

In one aspect, the needles are structured so as to move without bending inside the first length defining the whole longitudinal development of the needle seat.

In one aspect, the needle slides inside the needle seat by means of a linear movement of the needle itself, along the unitary direction of development of the first length, comprising the whole longitudinal development of the needle seat, said unitary direction of development being transversal with respect to the generating straight line.

In one aspect, the needle-holding element is a needle-holding cylinder, developing as a solid of rotation around said central axis, said working surface being an outer surface of the needle-holding cylinder having a vertical development and lying on planes parallel to the central axis, the needles being configured for sliding alternately and basically vertically inside the respective needle seat.

In one aspect, the needle-holding element is a needle-holding plate, developing as a solid of rotation around said central axis, said working surface being an upper surface of the needle-holding plate having a horizontal development and lying on a plane perpendicular to the central axis, the needles being configured for sliding alternately and basically horizontally inside the respective needle seat.

In one aspect, each needle control device or "stitch cam" comprises a respective cam path configured for intercepting the butts of the needles in rotation with the needle-holding element, so that the needle butts enter said cam path and are guided according to a given law of motion so as to make a given sliding movement inside the respective needle seat.

In one aspect, the cam path of each needle control device extends over its length from an inlet section on which the needles in rotation enter the cam path, to an outlet section on which the needles in rotation get out of the cam path.

In one aspect, each point of the cam path has a respective slope corresponding to the angle complementary to the smallest angle formed by a straight line tangent to said point of the path with a straight line passing through said point and oriented like said generating straight line. In one aspect, at least one portion of the cam path has points with a slope above 50° and/or above 55° and/or above 60° and/or above 70°.

In one aspect, the cam path comprises, in sequence from the inlet section to the outlet section:

- a first rising portion causing a movement of each needle towards the first open end of the respective needle seat so as to take the needle head out and reach a first position in which the knitted loop previously formed is cast off onto the stem;
- a second sinking portion causing a movement of each needle back into the respective needle seat so as to reach a second position in which the head—after picking up the yarn—sinks below the holding-down plane so as to form new knitted fabric;
- a third outlet portion comprising:
- a sinking length going farther in a continuous manner from the second sinking portion beyond the second position and ending up in a lower limit of the cam path, corresponding to the lower position taken by the needle butts in the stitch cam, wherein said sinking length corresponds to positions of the needle head below the holding-down plane;
- a rising length going farther in a continuous manner from said sinking length beyond the lower limit and ending up on said outlet section.

In one aspect, at least said sinking length of said third outlet portion of the stitch cam has points with a slope above 50° and/or above 55° and/or above 60° and/or above 70°.

In one aspect, after defining an angle of pressure corresponding to the angle formed for each point of the stitch cam by a direction of motion of the needle butt—perpendicular to the portion of needle seat housing the butt—with the point inclination or slope of the cam path (i.e. with the straight line tangent to the cam surface), the aforesaid inclination of the first length of the needle seat is configured for causing a reduction of the angle of pressure of a value corresponding to said angle of inclination of the first length with respect to a condition in which, the cam path being the same, said angle of inclination is zero.

In one aspect, with said slope of the cam path corresponding to an alpha angle and said angle of inclination of the first length of the needle seat corresponding to a beta angle, said angle of pressure tetha equals alpha minus beta.

In one independent aspect thereof, the invention relates to a needle-holding element for circular knitting machines, having a structure basically as a hollow solid of rotation developing around a central axis, the needle-holding element having at least one working surface shaped as a surface of rotation obtained through the rotation of a portion of generating straight line around the central axis, wherein on the working surface a plurality of needle seats is defined, placed one beside the other and arranged circumferentially or radially around said central axis, each needle seat being configured for movably housing at least a portion of at least one respective needle of the knitting machine, wherein at least one needle seat of said plurality of needle seats has a longitudinal development, on said working surface, inclined with respect to said generating straight line, preferably on the whole development thereof.

In one aspect, said needle seat is inclined with respect to a direction parallel or perpendicular to the central axis of the needle-holding element.

Each one of the aforesaid aspects of the invention can be considered alone or in combination with any one of the claims or of the other aspects as described.

Further characteristics and advantages shall be more evident from the detailed description of some embodiments, among which also a preferred embodiment, which are exemplary though not exclusive, of a needle-holding element for circular knitting machines and of a knitting machine comprising such an element, according to the present invention. This description shall be made below with reference to the accompanying drawings, provided to a merely indicative and therefore non-limiting purpose, in which:

FIG. 1 shows a schematic perspective view of two needle-holding elements for knitting machines of known technique; in particular, a needle-holding cylinder and a needle-holding plate can be seen;

FIG. 1A schematically shows the geometrical structure of a needle-holding element shaped as a needle-holding cylinder;

FIG. 1B schematically shows the geometrical structure of a needle-holding element shaped as a needle-holding plate;

FIG. 2 shows a perspective view of a needle control device or "stitch cam" of known technique;

FIG. 3 shows a front view of the needle control device of FIG. 2;

Figure 4:
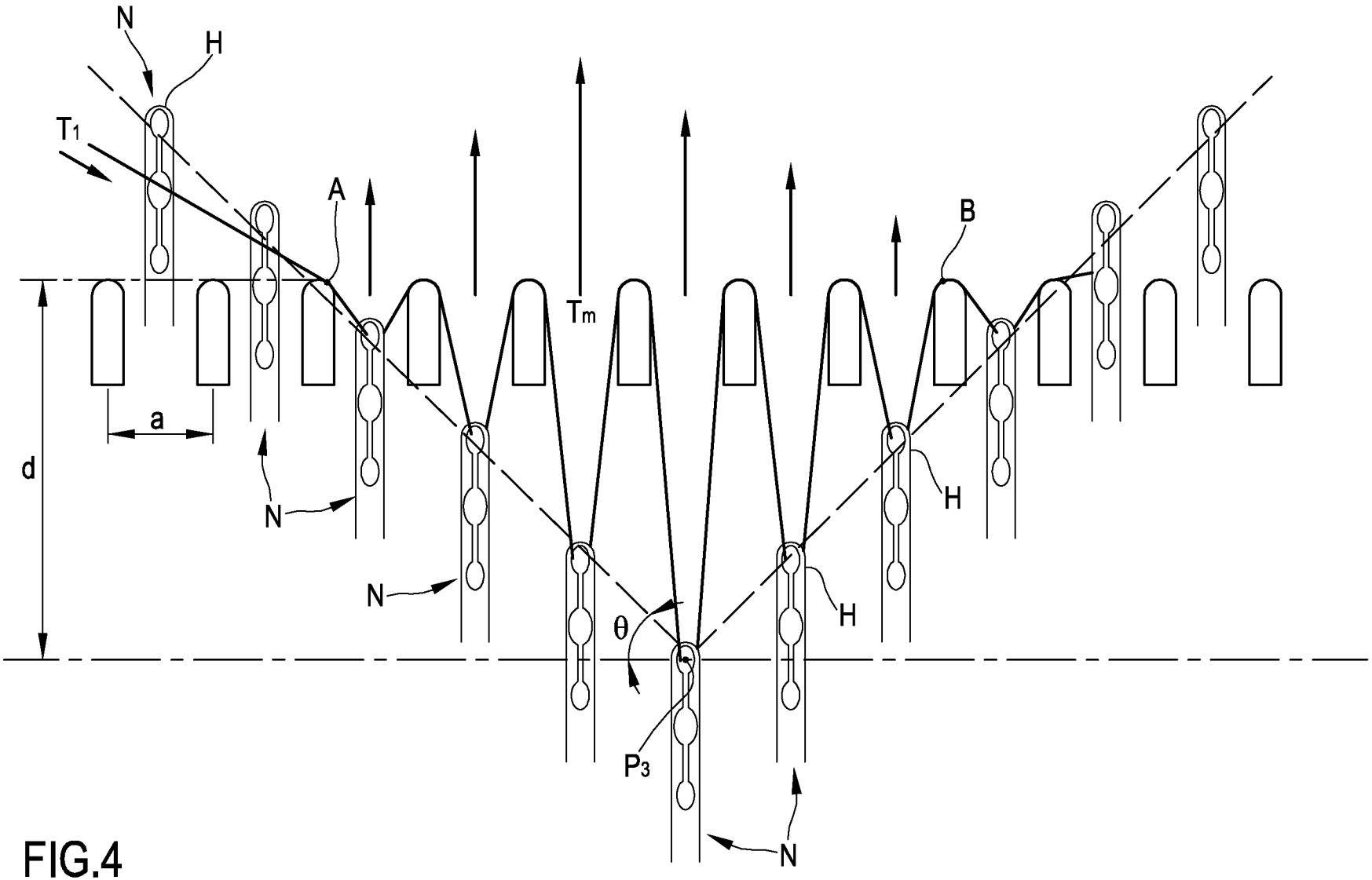
Figure 5:
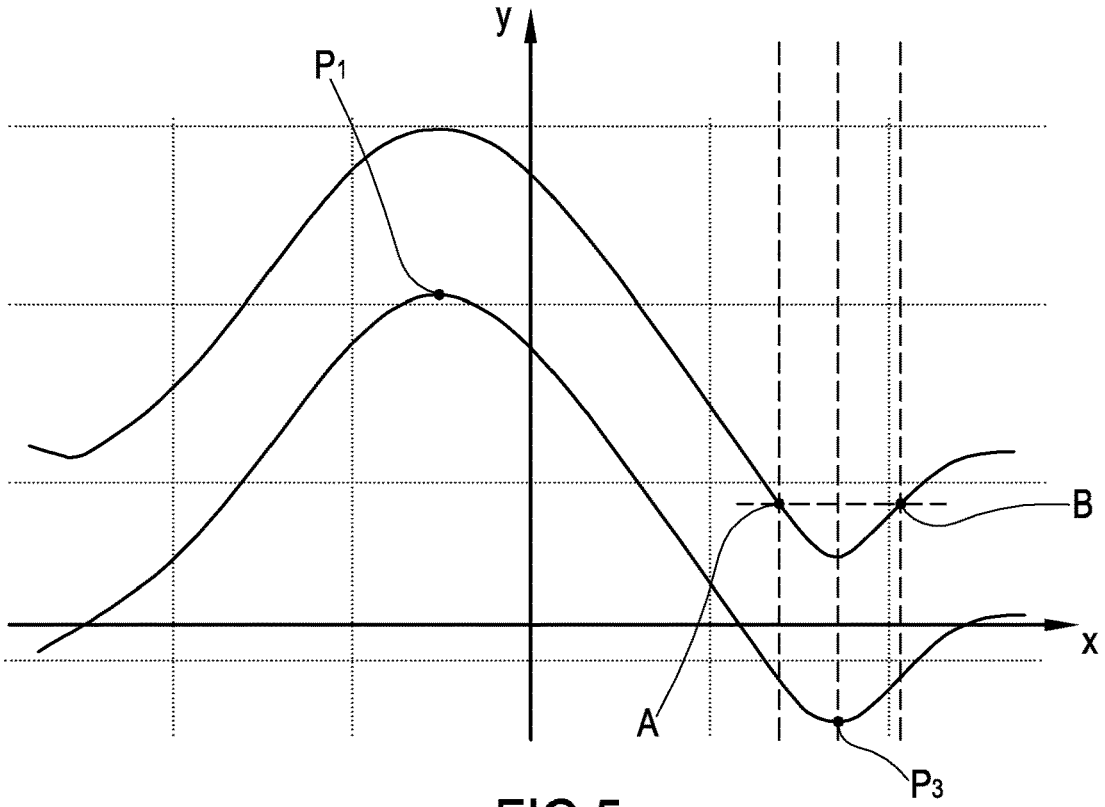
Figure 6:
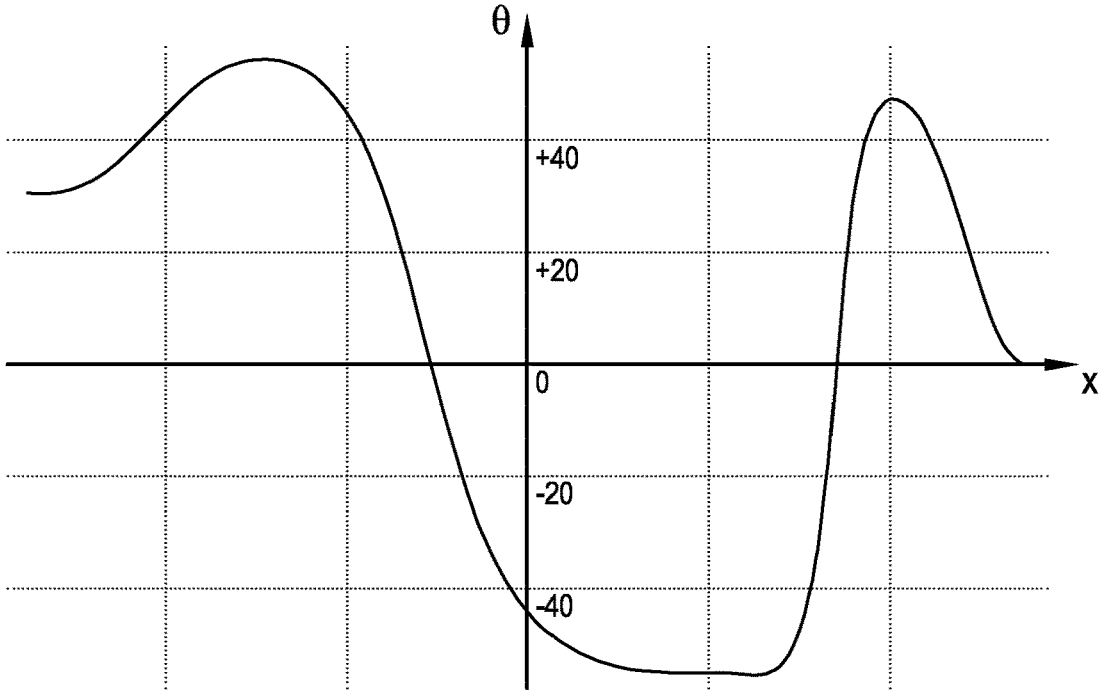
Figure 8:
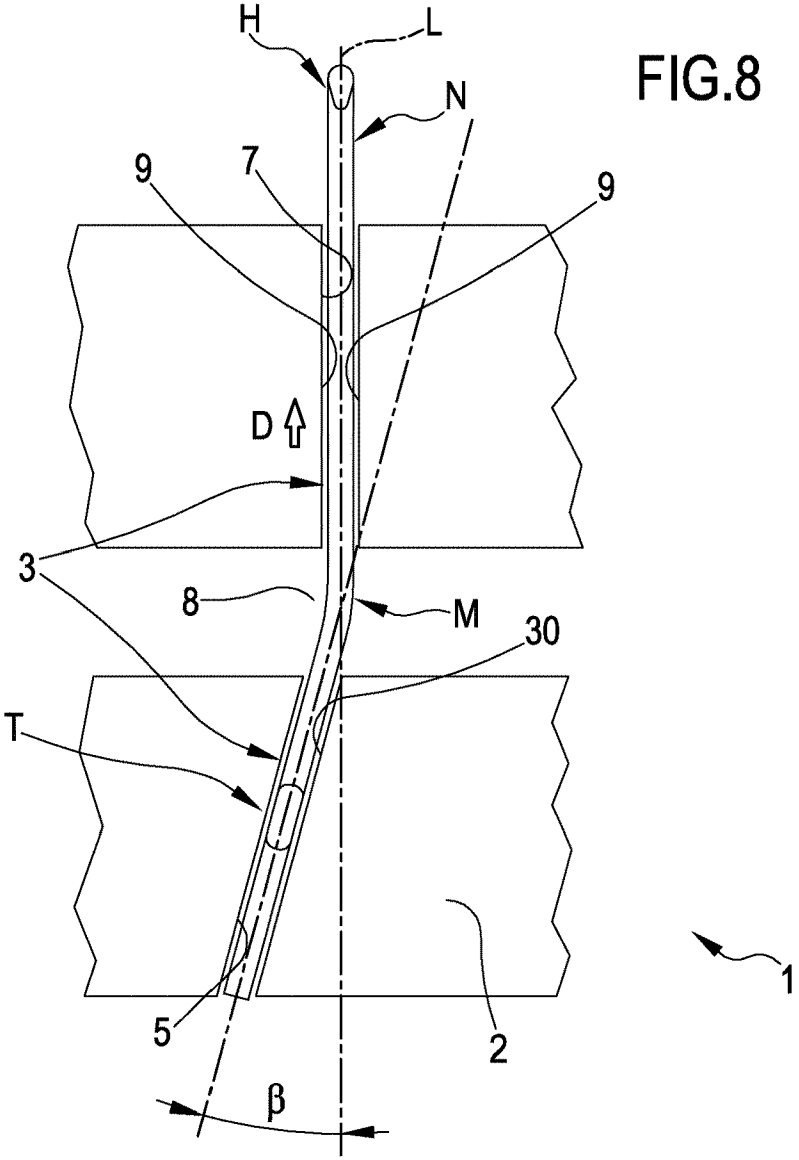
Figure 7:
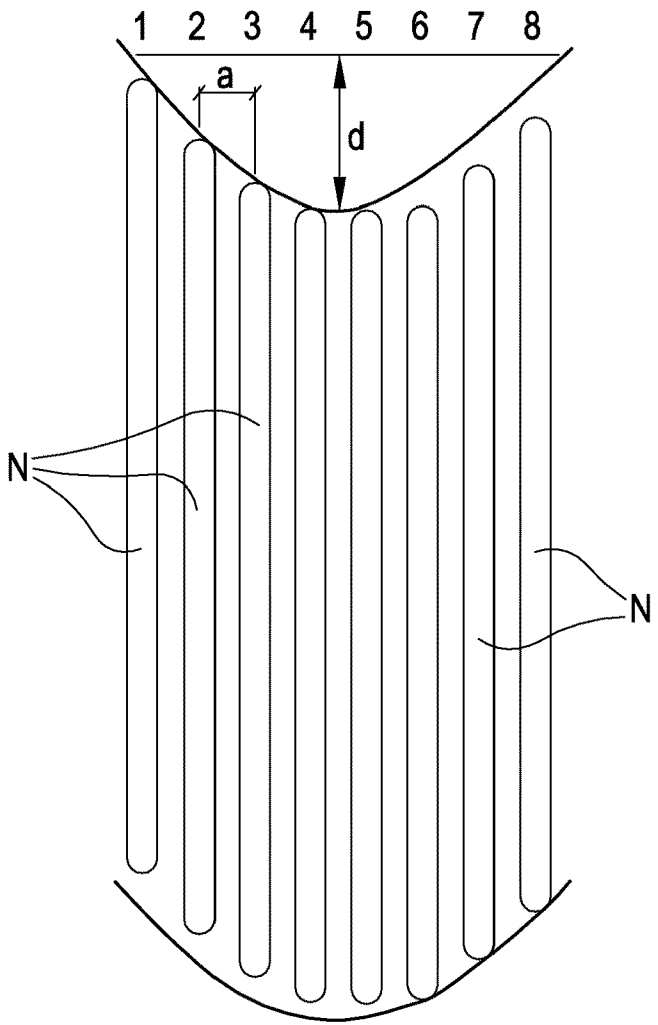
Figure 8A:
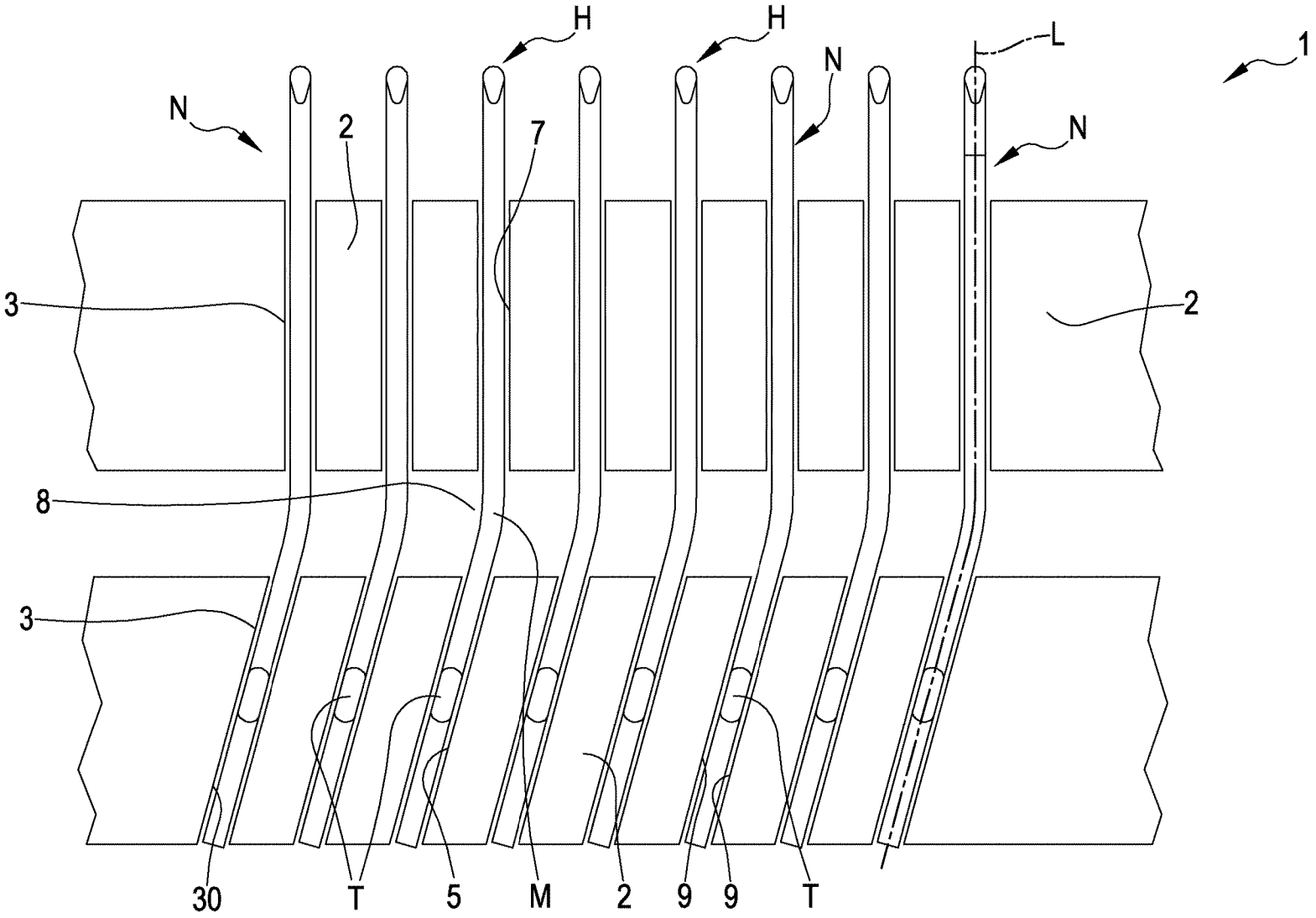
Figure 9:
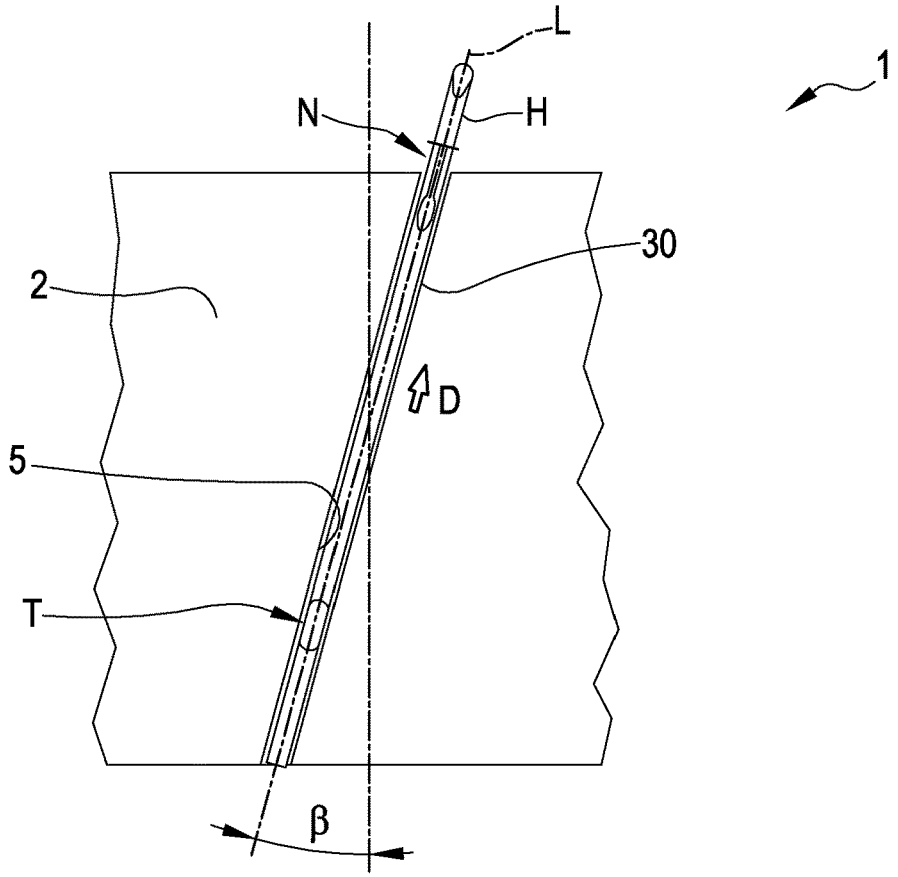
Figure 9A:
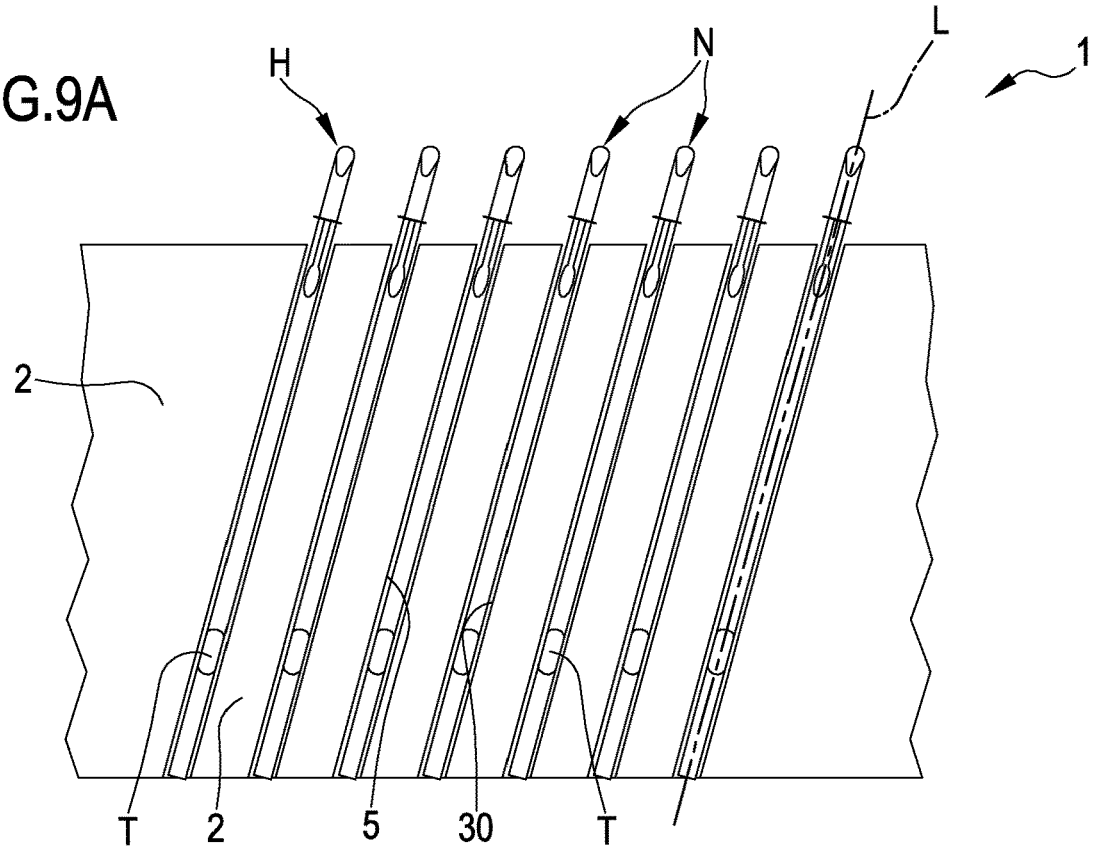
Figure 10A:
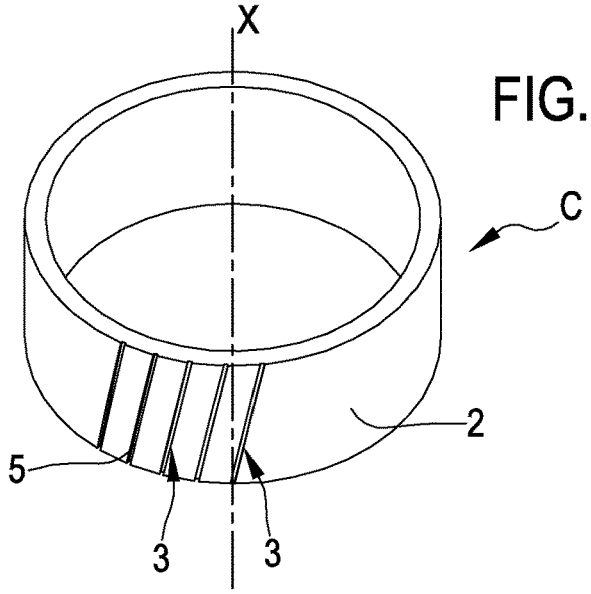
Figure 10B:
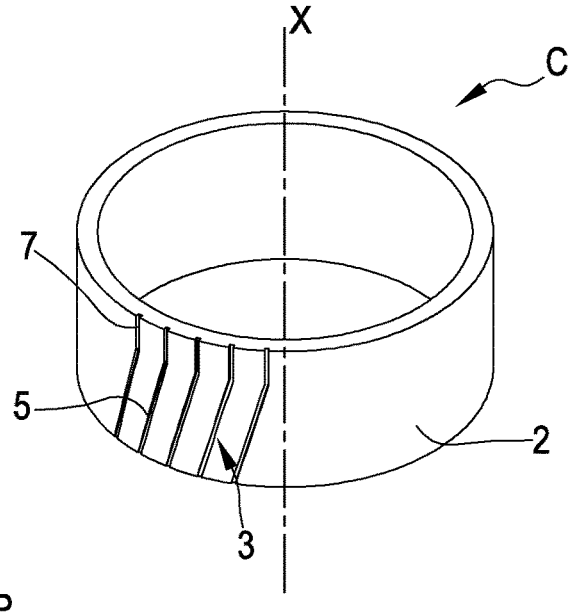
Figure 10C:
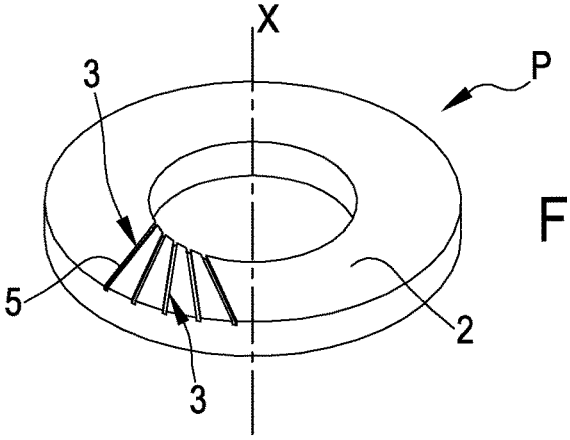
Figure 10D:
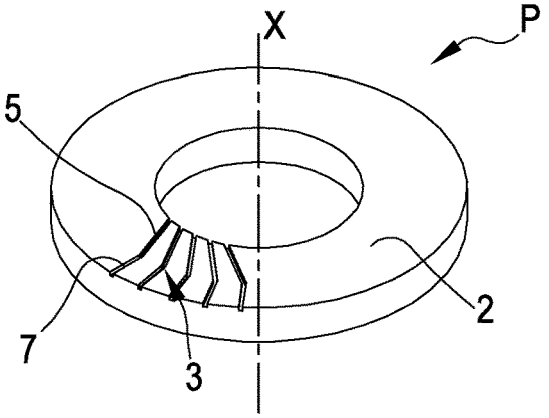
Figure 11A:
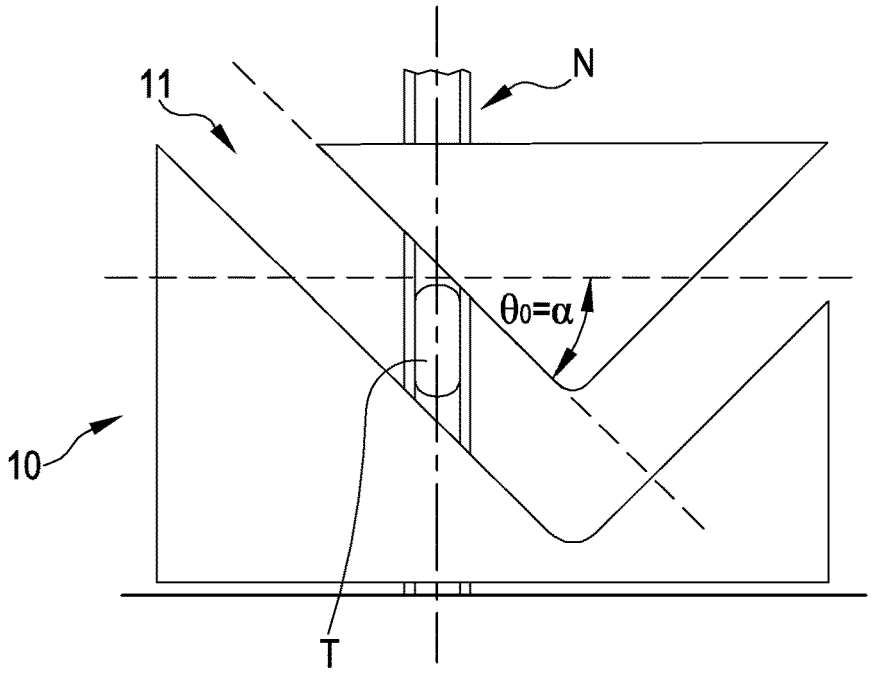
Figure 11B:
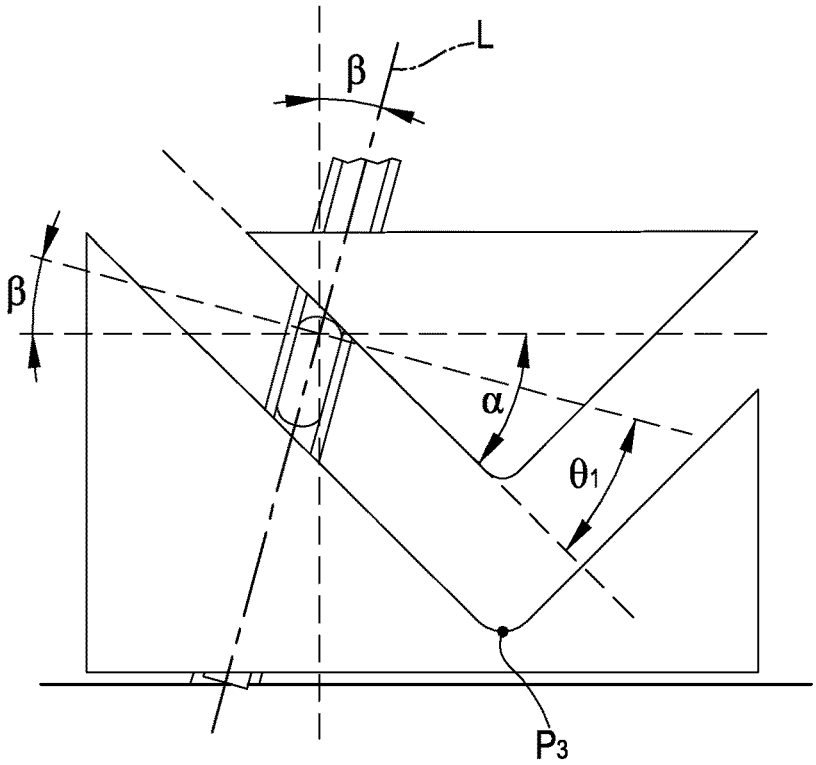

FIG. 4 schematically shows the motion of the needle heads during stitch formation; in particular, a plurality of needles in sequence, their passage below the holding-down plane and the path followed by a feeding yarn can be seen;

FIG. 5 is a graph schematically showing an example of stitch cam profile of known technique;

FIG. 6 schematically shows the development of the angle of pressure in each point of the stitch cam profile of FIG. 5;

FIG. 7 schematically shows the needles that are present at a given instant below the holding-down plane; this pattern is related to a given stitch cam profile of known technique and to a knitting machine with high fineness (e.g. 90);

FIG. 8 schematically shows a needle seat of a needle-holding element according to a possible embodiment of the present invention;

FIG. 8A schematically shows a needle-holding element according to an embodiment of the present invention, provided with a plurality of adjacent needle seats as shown in FIG. 8;

FIG. 9 schematically shows a needle seat of a needle-holding element according to a further embodiment of the present invention;

FIG. 9A schematically shows a needle-holding element according to an embodiment of the present invention, provided with a plurality of adjacent needle seats as shown in FIG. 9;

FIG. 10A schematically shows an embodiment of a needle-holding cylinder according to the present invention, provided with needle seats as shown in FIG. 9;

FIG. 10B schematically shows an embodiment of a needle-holding cylinder according to the present invention, provided with needle seats as shown in FIG. 8;

FIG. 10C schematically shows an embodiment of a needle-holding plate according to the present invention, provided with needle seats as shown in FIG. 9;

FIG. 10D schematically shows an embodiment of a needle-holding plate according to the present invention, provided with needle seats as shown in FIG. 8;

FIG. 11A schematically shows the interaction between a needle butt and a portion of the stitch path of a needle control device of known technique;

FIG. 11B schematically shows the interaction between a needle butt and a portion of the stitch path of a needle control device, wherein the needle is housed in a needle-holding element according to an embodiment of the present invention.

With reference to the mentioned figures, the numeral 1 globally designates a needle-holding element for circular knitting machines according to the present invention. Generally, the same numeral is used for identical or similar elements, if applicable in their variants of embodiment.

The needle-holding element 1 according to the present invention is designed to be introduced into a circular knitting machines for knitted items or seamless knitted items or for hosiery items. In further detail, the needle-holding element 1 is designed to be mounted in a circular knitting machine comprising at least:

- a supporting structure (or frame);
- the needle-holding element itself, turnably mounted to the frame so as to rotate around a central axis;
- a plurality of needles supported by the needle-holding element and moving so as to produce a knitted fabric;
- a plurality of yarn feeding points or "feeds", in which the needles of the machine are supplied with yarn, the feeds being placed circumferentially around the needle-holding element and angularly spaced one from the other.

The figures do not show the knitting machine for which the needle-holding element is designed; such a machine can be of conventional type and known per se.

From the point of view of knitting technology, the operation of the whole knitting machine is not described in detail, since it is known in the technical field of the present invention.

The needle-holding element 1 has a structure basically as a hollow solid of rotation (or revolution) developing around a central axis X, and is configured for rotating around this central axis and for supporting a plurality of needles N moving so as to produce a knitted fabric. In the present text, the wording "needle-holding element" designate "needle-holding cylinders" and "needle-holding plates", structures that are known in the field of circular knitting machines.

Figure 1:
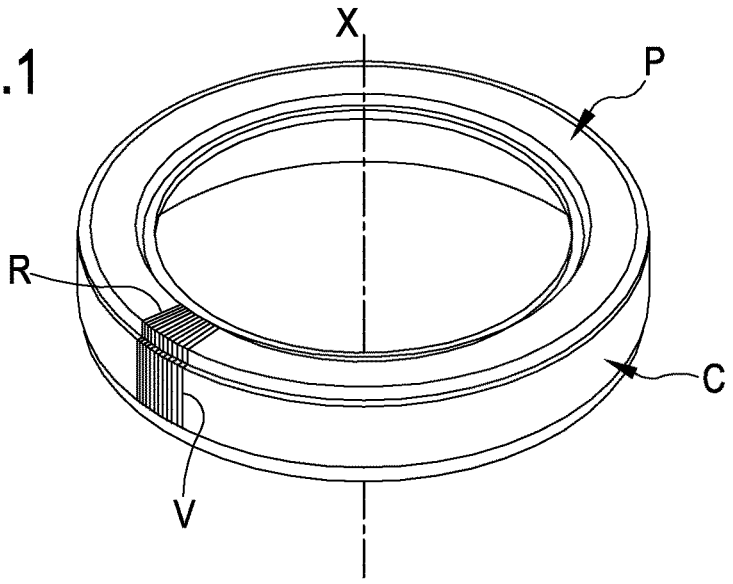
Figure 1A:
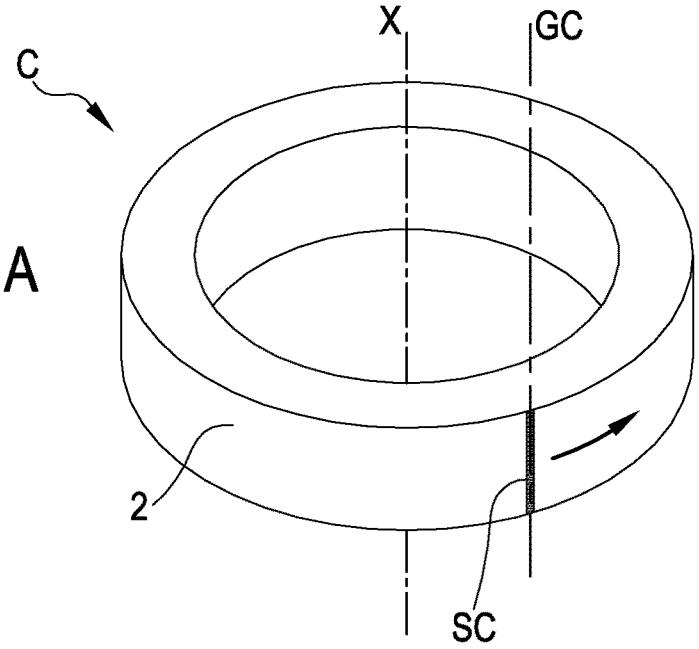

The needle-holding element 1 has at least one working surface 2 shaped as a surface of rotation (or revolution) obtained through the rotation of a portion of generating straight line (GC; GP) around the central axis (X). See to this purpose FIGS. 1A and 1B. FIG. 1A schematically shows a needle-holding cylinder C: it can be observed that it is first of all a solid of rotation developing around the central axis X; moreover, the outer surface 2 is a surface of rotation obtained by rotating the portion SC of a generating straight line GC around the central axis; this generating straight line GC is in this case parallel to the central axis X. In other words, by rotating the generating straight line GC around the central axis X, as represented by the arrow in FIG. 1A, the portion SC defines (or generates) the working surface 2, which in the case of a cylinder C is an outer cylinder surface lying on straight lines parallel to axis X.

Figure 1B:
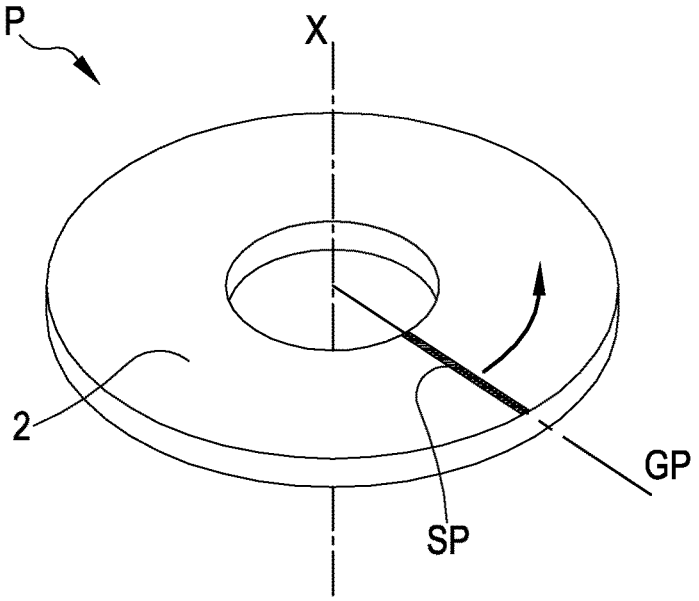

FIG. 1B schematically shows a needle-holding plate P: it can be observed that it is again a solid of rotation developing around the central axis X; in this case, the outer surface 2 is again a surface of rotation obtained by rotating the portion SP of a generating straight line GP around the central axis; this generating straight line GP is in this case radial to the central axis X. By rotating the generating straight line GP around the central axis X, as represented by the arrow in FIG. 1B, the portion SP defines (or generates) the working surface 2, which in the case of a plate P is an annulus surface lying on straight lines radial to axis X.

In the present text, the term "radial" means a straight line (or a direction) passing through the central axis X and lying on the working surface; in the form schematically shown in FIG. 1B, the generating straight line GP (radial with respect to the central axis X) is also perpendicular to the central axis X.

As schematically shown in FIGS. 1A and 1B, the aforesaid portion of generating straight line is a segment SC and SP. This segment defines the size of the working surface along a direction overlapping the generating straight line. Therefore, in a needle-holding cylinder the segment SC corresponds to the height of the cylinder surface, whereas in a needle-holding plate the segment SP corresponds to the radial extension of the working surface, i.e. to the difference between the outer and inner radii defining the annulus.

In both cases schematically shown in FIGS. 1A and 1B, on the working surface 2 a plurality of needle seats 3 is defined for the needles N. In the case of a needle-holding cylinder, the needle seats 3 are placed one beside the other and arranged circumferentially around the central axis X; in the case of a needle-holding plate, the needle seats 3 are placed one beside the other and arranged radially around the central axis X.

Each needle seat 3 is configured for movably housing at least one portion of at least one respective needle N of the knitting machine.

The wording "needle seat" designates the housing or groove designed to movably house at least one needle of the knitting machine during operation; in the technical field, this needle seat is also referred to as "sliding seat". The needle seats are therefore structures of the needle-holding element allowing the latter to support and guide the needles in the movement required for forming the knitted fabric.

The wording "on the working surface a plurality of needle seats is defined" means that the working surface comprises a plurality of needle seats obtained on the surface itself, e.g. by cutting the working surface or applying slats on the working surface. Typically, defining a needle seat consists in carrying out a groove or housing indented from the working surface and apt to house at least one needle. As an alternative, the needle seat can be a housing protruding from the working surface. In general, the needle seat has a suitable depth, along a direction transversal or perpendicular to the working surface, so as to house at least partially a respective needle. Moreover, the needle seat has a width, in a direction orthogonal to the longitudinal development thereof and along the working surface, apt to laterally contain said at least one needle; this width is sufficiently large as to contain the needle thickness.

In the present invention, as shall be explained in detail hereinafter, at least one needle seat 3 has at least a first length 5 having a longitudinal development, on the working surface 2, inclined (i.e. transversal) with respect to the generating straight line. Thus, this length is not parallel to the central axis X (in the case of a cylinder) and not arranged radially with respect to the central axis X (in the case of a plate).

Within the scope of the present description, the wording "longitudinal development", referred to a needle seat or to a length thereof, means the development in length of the seat (or of a length thereof) on the working surface, i.e. the main development with respect to depth and width. Therefore, considering the three dimensions of a needle seat (or of a length thereof) in space as length, width and depth, the longitudinal development is length. In FIGS. 8 and 9 the longitudinal development in length is schematically referred to with the arrow D; the development overlaps the axis referred to with letter L.

Within the scope of the present description, the term "inclined" with respect to the generating straight line means that the first length of the needle seat is inclined (i.e. forms an angle differing from zero) with respect to a generating straight line passing through it. As a matter of fact, as shown in FIGS. 1A and 1B, the generating straight line rotates around the central axis X so as to define the working surface, and therefore this generating straight line is a bundle of straight lines, parallel to axis X in the case of a cylinder and radial with respect to axis X in the case of a plate. Therefore, for each needle seat it is necessary to consider a generating straight line passing through the seat itself; it is thus possible to define the inclination of the first length.

Each needle seat 3 has a main longitudinal development L and is configured for laterally containing inside, at least partially, at least one respective needle N, so that the needle can slidably move in the needle seat following the longitudinal development L of the seat itself.

Typically, in known technique the longitudinal development of a needle seat is fully linear: in needle-holding cylinders the needle seats are wholly vertical and parallel to the central axis, whereas in needle-holding plates the needle seats are horizontal and arranged radially around the central axis. In both cases, in known technique the needle seats are rectilinear (developing along one straight line) and the needle motion is purely translatory. Moreover, considering the aforesaid definition of generating straight line, in known technique the needle seats always develop on their whole length along the respective generating straight line, and in particular overlap the respective segment of generating straight line.

Conversely, in the present invention at least one length of the needle seats is inclined with respect to the traditional orientation of the seats, i.e. a length inclined with respect to the generating straight line.

The first length 5 is configured for slidably housing at least a portion of the respective needle N comprising the butt T of the needle itself.

Preferably, each needle seat 3 is open at least on a respective first upper or front end, on which the head H of the needle housed in the needle seat can raise out during the production of the knitted fabric.

FIG. 8 shows a first embodiment of a needle-holding element according to the present invention. This figure can relate both to a portion of a needle-holding cylinder and to a portion of a needle-holding plate.

The aforesaid first length 5 is inclined with respect to the generating straight line of the working surface 2. In further detail, if the needle-holding element is a needle-holding cylinder, the first length 5 is inclined with respect to a direction parallel to the central axis X (since the generating straight line GC is parallel to the central axis), whereas if the needle-holding element is a needle-holding plate, the first length 5 is inclined with respect to a direction parallel to a direction radial to the central axis X (since the generating straight line GP is radial to the central axis).

In this embodiment, at least one needle seat 3 has a second length 7 transversal to the first length 5 and having a longitudinal development on the working surface 2 overlapping the generating straight line; in other words, the second length 7 has a longitudinal development lying on the generating straight line. Thus, if the needle-holding element is a needle-holding cylinder, the second length has a development on the working surface 2 parallel to the central axis X, whereas if the needle-holding element is a needle-holding plate, the second length 7 has a development on the working surface 2 radial to the central axis X.

The second length is configured for slidably housing at least a portion of the respective needle N comprising the head H of the needle itself.

Preferably, as shown in FIG. 8, the first length 5 and the second length 7 of the needle seat 3 are rectilinear and develop in respective directions; the first length and the second length form together an angle of inclination β (beta) different from zero.

Preferably, this angle of inclination is calculated as the smallest angle formed by the straight line corresponding to the direction of development of the first length with the respective straight line corresponding to the direction of development of the second length (see FIG. 8). Preferably, the angle of inclination beta (β) is greater than 0° and/or greater than 5° and/or greater than 10° and/or greater than 20° and/or greater than 30°; the angle of inclination is preferably smaller than 90° and/or smaller than 80° and/or smaller than 60°. By way of example, the angle beta can be 15°.

Preferably, the first length 5 and the second length 7 are arranged on the working surface 2 so as to define in a continuous manner the main longitudinal development L of the respective needle seat. In other words, although the first length and the second length form together an angle different from zero, the needle seat develops in a continuous manner so as to be able to house at least one needle inside.

Preferably, as shown in FIG. 8, the first length 5 and the second length 7 of the needle seat 3 are arranged on the working surface 2 so as to cause, for each movement of the respective needle N inside the needle seat, the needle itself to bend so as to follow the main longitudinal development L of the needle seat.

In a possible embodiment, as shown by way of example in FIG. 8, the needle seat 3 has an intermediate length 8 placed between and connecting the first length and the second length 7; this intermediate length 8 is configured for slidably housing at least an intermediate portion M of the respective needle N, placed between the butt T and the head H of the needle itself and configured to bend when the needle slides inside the respective needle seat.

The needle seat has two side walls 9 opposed and facing each other, among which a hollow 30 indented from the working surface 2 is defined, inside which the needle N is slidably housed; the hollow 30 extends along the aforesaid longitudinal development L. Preferably, the two side walls 9 develop in a continuous manner on the whole longitudinal development L of the needle seat, laterally delimiting the hollow 30.

As an alternative, as shown by way of example in FIG. 8, the two side walls can develop on the first length 5 and on the second length 7 and be interrupted on the intermediate length 8, so as to make it easier for the needle N to bend during its movement inside the needle seat. In this case, the portion of the needle-holding element in which the intermediate lengths are defined is not provided with distinct hollows but with one annular hollow, indented from the working surface and globally defining the intermediate lengths of all the needle seats. Preferably, the first length 5 of the needle seat 3 is inclined with respect to the second length 7 so as to lie at the back with respect to the second length, along a direction of rotation, during use, of the needle-holding element. Basically, the first length is inclined "backwards" with respect to the second length, considering the sense of rotation of the needle-holding element.

Preferably, as shown by way of example in FIG. 8A, the needle-holding element comprises a plurality of needle seats placed one beside the other, identical to each other and having all the same respective angle of inclination β between the respective first 5 and second length 7.

A further embodiment according to the present invention is described below and schematically shown in FIG. 9.

In this embodiment, the first length 5 is configured for completely housing at least one respective needle N, i.e. the first length comprises the whole longitudinal development L of the needle seat 3 and overlaps it.

Therefore, if the needle-holding element is a needle-holding cylinder, the whole needle seat 3 is inclined with respect to a direction parallel to the central axis X (since the generating straight line GC is parallel to the central axis), whereas if the needle-holding element is a needle-holding plate, the whole needle seat is inclined with respect to a direction parallel to a direction radial to the central axis X (since the generating straight line GP is arranged radially to the central axis). In both cases, be it a needle-holding cylinder or a needle-holding plate, no second length is present since the whole needle seat overlaps the first length, which is completely inclined. In this embodiment, the first length (corresponding to the whole seat) is configured for housing the whole needle N, and thus both the portion comprising the butt T and the portion comprising the head H.

Preferably, the first length 5 of the needle seat, corresponding to the whole needle seat 3 itself, is rectilinear and develops in a respective unitary direction of development, which is transversal with respect to said generating straight line.

The aforesaid unitary direction of development forms with the generating straight line an angle of inclination β different from zero, as shown by way of example in FIG. 9.

In other words, in this embodiment the needle seat 3 comprises one rectilinear length having one angle of inclination different from zero with respect to the generating straight line, lying on and defining said working surface. This one rectilinear length corresponds from a functional point of view to the first length described in the solution of FIG. 8, though in this case it extends as far as the upper end of the needle seat.

Preferably, as schematically shown in FIG. 9, the angle of inclination β is calculated as the smallest angle formed by the straight line corresponding to the unitary direction of development of the needle seat with the generating straight line GC or GP.

Preferably, the angle of inclination beta (β) is greater than 0° and/or greater than 5° and/or greater than 10° and/or greater than 20° and/or greater than 30° and/or smaller than 90° and/or smaller than 80° and/or smaller than 60°. By way of example, the angle beta can be 15°.

Preferably, the needle seat is inclined so that its portion housing the needle butt lies at the back with respect to the portion housing the needle butt, along a sense of rotation, during use, of the needle-holding element. Basically, the seat portion housing the butt is inclined "backwards" with respect to the portion housing the needle head, considering the sense of rotation of the needle-holding element.

As shown by way of example in FIG. 9A, preferably all the needle seats are identical to each other and all have the same respective angle of inclination.

Preferably, as in the embodiments schematically shown in the figures, the needle-holding element 1 is a needle-holding cylinder, developing as a solid of rotation around the central axis X; in this case, the working surface 2 is an outer surface of the needle-holding cylinder having a vertical development and lying on planes parallel to the central axis X.

Preferably, the second length 7 of the needle seat 3 (according to the embodiment of FIG. 8) is arranged on the working surface 2 of the needle-holding cylinder parallel to the central axis X. Preferably, the second length 7 of the needle seat 3 develops, on the working surface during use of the needle-holding cylinder, above with respect to the first length 5.

According to the embodiment of FIG. 9, wherein the first length 5 comprises the whole longitudinal development L of the needle seat and is configured for completely housing at least one respective needle N in at least one operating position, the needle seat has on its whole longitudinal development an angle of inclination, preferably constant, with respect to straight lines lying on the working surface 2 and parallel to the central axis X. In a further embodiment, the needle-holding element is a needle-holding plate developing as a solid of rotation around the central axis, and the working surface is an upper surface of the needle-holding plate lying on a plane perpendicular to the central axis, i.e. having a horizontal development in use.

Preferably, the second length of the needle seat (according to the embodiment of FIG. 8 for a needle-holding plate) is arranged on the working surface of the needle-holding plate radially with respect to the generating straight line (i.e. it intersects and is perpendicular to the generating straight line). Preferably, the first length develops, on the working surface during use of the needle-holding plate, in a position radially near the central axis with respect to the second length.

According to a further embodiment, as shown in FIG. 9 and for a needle-holding plate, wherein the first length comprises the whole longitudinal development of the needle seat and is configured for completely housing at least one respective needle, the needle seat has on its whole longitudinal development an angle of inclination, preferably constant, with respect to straight lines lying on the working surface (horizontal in use) and radial with respect to the central axis.

It should be observed that FIGS. 8A and 9A show a portion of working surface 2 having a plurality of needle seats as in FIGS. 8 and 9, respectively. FIGS. 8A and 9A can be considered as a development on a plane of the working surface 2 and are useful for schematically representing the present invention both for a needle-holding cylinder and for a needle-holding plate. As a matter of fact, the "strip-like" shape of the working surface in FIGS. 8A and 9A is obtained by "cutting" the working surface 2 along the generating straight line and "opening" it so as to obtain a rectilinear surface.

In general, the technical features underlying the present invention in its various embodiments, can be implemented in a fully equivalent manner both with the needle-holding element as a needle-holding cylinder and with the needle-holding element as a needle-holding plate. As a matter of fact, from a geometrical point of view and keeping in mind textile technology, the needle-holding cylinder and plate are homologous elements, and both can be schematically represented, as shown in FIGS. 1A and 1B, as solids of rotation (or revolution). In addition, both the cylinder and the plate have a working surface (on which the needle seats are present) having the shape of a surface of rotation (or revolution), i.e. a surface obtained by rotating a portion (SC or SP) of generating straight line (GC or GP) around the same central axis X. In both cases the working surface develops schematically around the central axis X: in the cylinder it is a vertical cylinder surface, in the plate it is an annular (or annulus) plane surface.

Therefore, from a conceptual point of view, the needle seats having at least one inclined portion or wholly inclined, can be carried out both on a cylinder and on a plate: on the cylinder the seats are carried out vertically, on the plate they are carried out radially, without limiting in any manner the implementation of the technical features here described for the needle seats.

FIGS. 10A-10D schematically show the various embodiments described above according to the present invention, and in particular: FIG. 10A a needle-holding cylinder C with needle seats as shown in FIG. 9, FIG. 10B a needle-holding cylinder C with needle seats as shown in FIG. 8; FIG. 100 a needle-holding plate P with needle seats as shown in FIG. 9; FIG. 10D a needle-holding plate P with needle seats as shown in FIG. 8. In these figures, the needle seats are shown—for simplicity's sake—for an angular portion of the cylinder or plate only; in the actual needle-holding elements carried out according to the present invention, the needle seats preferably extend on the whole working surface.

Below is described a circular knitting machine according to the present invention, which uses a needle-holding element as described above.

The knitting machine comprises:

- a frame;
- a needle-holding element 1 according to the present invention;
- a plurality of needles movably introduced into the needle seats of the needle-holding element and moving so as to produce a knitted fabric;
- a plurality of needle control devices 10 or "stitch cams" 10, configured for interacting with the needles N, in particular with the needle butts T, so as to transmit to the needles a given movement inside the respective needle seat during the rotation of the needle-holding element.

Within the scope of the present invention, needle means—as known in the field of knitting machines—a knitting element made up of a stem, which extends between an upper portion, on which the needle head is defined, configured for interacting with the yarns so as to produce a knitted fabric, and a lower portion, on which the needle butt is defined, configured for interacting with said control devices. Each needle of the knitting machine is made as one piece, wherein the head and the butt are connected to each other in a continuous manner and move integrally inside the respective needle seat.

If the needle is housed in a seat of a needle-holding cylinder, the butt protrudes outside from the working surface; as a matter of fact, if the needle is housed in a seat of a needle-holding plate, the butt protrudes above from the working surface.

Each needle is further configured for moving slidably with an alternate motion inside the respective needle seat, following the main longitudinal development L of the seat.

As is known in textile technology, each needle can be actuated with an alternate motion along the respective needle seat, including a motion of extraction by which the needle is taken out at least with its head above of the needle-holding element through an upper end of the respective needle seat for discharging on its stem the knitted loop previously formed and/or for taking the yarn or yarns supplied on a machine feed, and a motion of return by which the needle is returned with the head into the respective needle seat so as to form a new knitted loop by holding down the knitted loop previously formed and produce knitted fabric.

In a knitting machine having a needle-holding element according to the embodiment shown in FIG. 8, the needles are structured for bending so as to follow the longitudinal development L of the needle seat 3, i.e. so as to follow the development of the first length 5 and of the second length 7 of the needle seat.

Preferably, each needle comprises an intermediate portion M of its stem placed between and connecting the upper portion and the lower portion of the needle. This intermediate portion is designed to be placed on an intermediate length 8 of the needle seat 3 and is configured for bending during the sliding of the needle inside the respective needle seat, so that the lower portion of the needle, comprising the butt T, can slide with an alternate motion in the first length 5 of the needle seat, and the upper portion of the needle, comprising the head H, can slide with an alternate motion in the second length 7 of the needle seat.

Preferably, the intermediate portion M of the needle N has a smaller cross section than a cross section of the upper portion of the needle and/or than a cross section of the lower portion of the needle, so that the upper portion and the lower portion can mutually bend during the alternate motion of the needle in the respective needle seat 3.

Preferably, the intermediate portion M of the needle has a relief or discharge on which the lower portion of the needle is bent with respect to the upper portion of the needle to an extent corresponding to the angle of inclination β between the first length and the second length of the needle seat.

As an alternative, the intermediate portion M of the needle could comprise a hinge or joint or other connection; thus the needle would comprise two rectilinear portions (one supporting the butt, the other supporting the head) connected by a swivel joint.

Preferably, with reference to the embodiment of FIG. 8, the needle slides inside the needle seat by means of a composite movement of the needle itself, wherein the upper portion of the needle shifts along the direction of development of the second length of the needle seat, the lower portion of the needle shifts along the respective direction of development of the first length of the needle seat, and the intermediate portion of the needle moves with successive bending movements in the intermediate length of the needle seat, alternately towards the first length and towards the second length.

In the knitting machine having a needle-holding element according to the embodiment shown in FIG. 9, the needles are structured so as to move without bending inside the first length, comprising the whole longitudinal development L of the needle seat 3.

Preferably, the needle slides inside the needle seat by means of a linear movement of the needle itself, along the unitary direction of development of the first length, comprising the whole longitudinal development of the needle seat. This unitary direction of development is transversal with respect to said generating straight line; in other words, the unitary direction of development is inclined with respect to a straight line parallel (in the case of a needle-holding cylinder) or radial (in the case of a needle-holding plate) to the central axis and lying on the working surface.

If the needle-holding element is a needle-holding cylinder, the needles are configured for sliding alternately and basically vertically inside the respective needle seat. In other words, the movement of the needles in the needle-holding cylinder occurs vertically upwards and downwards.

If the needle-holding element is a needle-holding plate, the needles are configured for sliding alternately and basically horizontally inside the respective needle seat. In other words, the movement of the needles in the needle-holding plate occurs horizontally getting near the central axis and away from the central axis.

FIGS. 2 and 3 show by way of example a needle control device 10 or "stitch cam" of known technique.

Each needle control device 10 or "stitch cam" of the knitting machine comprises a respective cam path 11 configured for intercepting the butts T of the needles in rotation with the needle-holding element, so that the needle butts enter the cam path and are guided according to a given law of motion so as to make a given sliding movement inside the respective needle seat 3.

Preferably, each needle control device 10 is mounted in a respective position to the fixed frame of the knitting machine, so that—during the rotation of the needle-holding element—there is a mutual speed between the control devices and the needle-holding element. The control devices 10 are configured for providing the needles N, through the interaction with the butts T of the needles themselves, the force required to move them inside the respective needle seat 3.

Preferably, the needle control devices 10 are arranged on the frame of the knitting machine so as to be facing the working surface 2 of the needle-holding element 1.

Preferably, each needle control device 10 interacts in sequence with the needles N in rotation with the needle-holding element, so as to impart in sequence the same movement to all the needles in the respective needle seat 3, wherein each needle makes the movement with a given delay.

Preferably, the cam path 11 of each needle control device 10 extends over its length from an inlet section 12 on which the needles in rotation enter the cam path, to an outlet section 13 on which the needles in rotation get out of the cam path 11.

Preferably, as is known, the cam path 11 of each needle control device 10 has for each point of its length a given height, which corresponds to a given position of the needle inside the respective needle seat. The height development for each point of the cam path along its length defines the aforesaid law of motion of the sliding movement of each needle in the respective needle seat.

The cam path 11 of a needle control device 10 is shown by way of example in the graph of FIG. 5; the abscissa x represents the length of the stitch cam (from the inlet section to the outlet section), whereas the ordinate $\gamma$ represents the height of the cam path for each point of the development in length.

As shown in FIGS. 2, 3 and 5, each point of the cam path 11 has a respective slope (alpha, $\alpha$) corresponding to the angle complementary to the smallest angle formed by a straight line tangent to said point of the path with the generating straight line. As an alternative, the slope $\alpha$ can be regarded as the angle complementary to the smallest angle formed by a straight line tangent to the point of the path with a straight line passing through said point and parallel (in the case of a needle-holding cylinder) or radial (in the case of a needle-holding plate) to the central axis X.

Preferably, at least one portion of the cam path 11 has points with a slope above 50° and/or above 55° and/or above 60° and/or above 70° and/or above 80°. By way of example, the slope can reach a value of 80°.

The cam path 11 comprises, in sequence from the inlet section 12 to the outlet section 13:

- a first rising portion 14 causing a movement of each needle N towards the first open end of the respective needle seat 3 so as to take the needle head out and reach a first position P1 in which the knitted loop previously formed is cast off onto the stem;
- a second sinking portion 15 causing a movement of each needle back into the respective needle seat so as to reach a second position P2 in which the head—after picking up the yarn—sinks below the holding-down plane so as to form new knitted fabric;
- a third outlet portion 16 comprising:
- a sinking length 17 going farther in a continuous manner from the second sinking portion 15 beyond the second position P2 and ending up in a lower limit P3 of the cam path 11, corresponding to the lower position taken by the needle butts in the stitch cam, wherein the sinking length 17 corresponds to positions of the needle head below the holding-down plane;
- a rising length 18 going farther in a continuous manner from the sinking length 17 beyond the lower limit P3 and ending up on the outlet section 13.

Preferably, the third outlet portion 16 defines positions of the needle head which are all below the holding-down plane.

Preferably, at least the sinking length 17 of the third outlet portion 16 of the stitch cam 11 has points with a slope above 50° and/or above 55° and/or above 60° and/or above 70°.

An "angle of pressure" (theta, $\theta$) is now defined, corresponding to the angle formed for each point of the stitch cam 11 by a direction of motion of the needle butt—perpendicular to the portion of needle seat housing the butt itself—with the point inclination or slope of the cam path (i.e. with the straight line tangent to the cam surface). The aforesaid inclination of the first length 5 of the needle seat is configured for causing a reduction of the angle of pressure θ of a value corresponding to the aforesaid angle of inclination β of the first length with respect to a condition in which, the cam path being the same, said angle of inclination is zero.

In other words, considering the slope of the cam path corresponding to an α (alpha) angle and the angle of inclination of the first length of the needle seat corresponding to a β (beta) angle, the angle of pressure tetha equals α-β.

With reference to FIGS. 11A and 11B, the reduction of the angle of pressure obtained by inclination of the first length of the needle seat (which can comprise a portion of the seat, as in FIG. 8, or the whole seat on its whole length, as in FIG. 9), is described below.

It should be observed that FIGS. 11A and 11B show a portion of the cam path 11 corresponding to the aforesaid third portion 16; basically, these figures schematically show the interaction between the buts and the cam path between points A and B, as in FIG. 4.

FIG. 11A shows a needle control device 10 and a needle N housed in a needle-holding element according to known technique. The needle is arranged as not inclined since it is housed in a needle seat according to known technique (and therefore parallel or radial with respect to the central axis of the cylinder). The angle α in FIG. 11A is the angle formed between the straight line tangent to the cam path (i.e. the straight line representing the slope of the cam path) and a straight line corresponding to the horizontal direction of motion of the needle supported by the cylinder (or similarly a straight line perpendicular to the vertical development of the needle). This angle α, in known technique, corresponds to the angle of pressure as defined above; in a formula:

$$\theta 0=\alpha.$$

The angle of pressure of FIG. 11A, referred to as "θ0", is therefore the typical angle of pressure of known technique, wherein the seats are not inclined. As described above, this angle of pressure should not exceed a limit value (of about 55°) in order to avoid a possible butt break (e.g. due to sticking in the cam path).

Conversely, FIG. 11B shows the situation according to the present invention. In this case, the needle is represented as inclined (with its lower portion lying back) since it is housed in a needle seat having the first length inclined with respect to a (vertical) straight line parallel to the central axis X of the needle-holding cylinder. This inclination of the lower part of the needle seat, and therefore of the needle portion supporting the butt, applies both to the embodiment of FIG. 8, in which the seat is inclined in a lower portion thereof only, and to the embodiment of FIG. 9, in which the seat is fully inclined (on its whole length). The inclination of the needle determines a new and different value of the angle of pressure, referred to as θ1: as a matter of fact, the angle of pressure is still calculated as the angle between the straight line tangent to the cam path (i.e. the slope) and the straight line perpendicular to the vertical development of the needle (and perpendicular to the butt). Therefore, the slope of the cam path being the same (as in the two stitch cams of FIGS. 11A and 11B), varying the straight line perpendicular to the needle (due to the inclination), the new angle of pressure is reduced with respect to the case of FIG. 11A precisely of a value corresponding to the inclination of the first length of the needle seat. In a formula (see FIG. 11B):

$$\theta 1=\alpha-\beta.$$

Basically, the solution underlying the present invention in its embodiments, enables to obtain—the cam path being the same—an actual angle of pressure that is smaller with respect to the solution of known technique. The reduction of the angle of pressure with the inclines seats according to the present invention is the same as or proportional to the angle of inclination.

The invention thus conceived can be subjected to various changes and variants, all of which fall within the scope of the inventive idea, and the components mentioned here can be replaced by other technically equivalent element.

The present invention can be used both on new and on existing machines, in the latter case replacing traditional needle-holding elements. The invention achieves important advantages. First of all, the invention allows to overcome at least some of the drawbacks of known technique. In further detail, the advantages resulting from the shape of the needle seats according to the present invention are described.

As described at the beginning, it is known about a limit (about 55°) for the angle of pressure, and therefore for the slope of the cam path of a needle control device. Beyond this limit the efforts on the butts (in their interaction with the stitch cam) can cause the breaking thereof. It would however be desirable to be able to increase the slope, since a higher slope results in a smaller number of needles simultaneously engaged below the holding-down plane, and therefore a smaller tension on the yarns. Basically, yarn tension can be limited (and the problem of yarns breaking can be solved) by increasing the angle of pressure (and therefore the slope), but this causes the needle butts to break.

The structure of the needle seats according to the present invention precisely allows to solve or at least reduce this drawback. As a matter of fact, the inclination at least of the needle seat length housing the needle butt, causes a reduction of the actual angle of pressure, i.e. the passage from value θ (theta) to value θ1 (theta1), as schematically shown in FIGS. 11A and 11B. The reduction of the angle of pressure is the same as or proportion precisely to the angle of inclination β (beta).

The advantage in terms of reduction of the actual angle of pressure has been shown considering the same cam profile, i.e. the same needle control device. In other words, considering a slope of the profile already at the limit value of 55° of the angle of pressure (in the case of FIG. 11A), the inclination of the seat has resulted (FIG. 11B) in an actual angle of pressure of 55°−β. It is now evident that, the actual angle of pressure having been reduced, we are below the butt breaking limit and the slope can therefore be increased again. In particular, the new slope can be increased up to 55°+β.

It should be observed that in known technique the angle of pressure is basically related to the slope of the cam profile only, whereas in the solution of the present invention it is related both to the slope and to the inclination of the seat. Therefore, by selecting an inclination for the needle seat, the cam path can be shaped with higher slopes.

The higher slope that can be obtained for the cam path in the sinking length 17 of the third portion 16 of the cam path, i.e. in the length from point A to point P3 in the figures, enables precisely to reduce the needles simultaneously below the holding-down plane, and thus to limit the tension on the yarns without causing the butts to break. It should be reminded that the reduction of tension thanks to the smaller number of needles below the holding-down plane is due to the fact that there is a smaller number of needles simultaneously blocking and braking the yarn (see FIG. 4).

It is therefore advantageously possible to increase the fineness of the knitting machine, i.e. the number of needle per inch, since the tensions on the yarns are reduced with respect to known technique. Thanks to the solution of the present invention it is therefore possible to increase the speed of rotation of the needle-holding element. Ultimately, the solution of the present invention enables to reduce the actual angle of pressure on the butts so as to obtain a steeper sinking of the heads. The fast sinking in the portion from A to P3 enables to improve knitting performance since it causes a fast stitch loading.

A further advantage due to the possibility of increasing the slope of the stitch path in the stitch loading part (points A-P3) consists in that the inclination "backwards" of the needle seat causes an inclination of the butt (FIG. 11B) contributing to prevent the butt itself from being blocked in the cam path. Basically, should the efforts transmitted to the butt by the stitch cam profile increase, the inclination β of the but would contribute to make it slightly get back and prevent it from sticking. This phenomenon allows to obtain a further advantage. As a matter of fact, in the part of the stitch path corresponding to stitch loading (sinking length from point A to point P3), it should be considered that the inclination of the seat makes the effort imparted by the stitch cam not cause the but to stick but to get back with respect to the sense of rotation of the needle-holding element. Therefore, beyond the aforesaid increase of the slope corresponding to the inclination β, it is possible to introduce a further and additional increase of the slope, precisely due to the fact that the butt slides with an inclination inside the cam path and tends to get free from efforts autonomously.

The increase of the slope of the cam path that can be obtained thanks to the inclination of the needle seat, could also be executed in other portions of the cam path beyond the one shown in FIG. 11B.

However, it could be advantageous—considering an increase of the slope in the sinking length of the cam path to reduce the slope in the rising length, so as to slowly cast off the produced stitch. This does not give rise to problems since—even though the needles present in the rising length increase—the needles are casting off the stitch already formed and there are no considerable efforts on the needle butts.

Ultimately, in the same stitch cam the possibility to increase the slope in the sinking length of the cam path enables to reduce the length thereof and to have more space on the stitch cam length for the rising portion (casting off of the old stitch).

A further advantage that can be obtained with the solution of the present invention is an improvement during so-called "vanise" (or plated) processing. In this processing two yarns are present inside the needle, one of them being typically Lycra: the two yarns should be accurately positioned inside the head without disturbing or interfering with each other. In this situation, a rapid sinking (in the length from point A to point P3) of the heads, which can be obtained thanks to higher slope (which can be obtained in its turn by seat inclination), enables to take up the yarns in a faster and more accurate manner. Thus, the interaction between the yarns and the stem is reduced, which could cause the yarns to roll up leading to a low-quality plated fabric. Moreover, the present invention enables to increase the performance of a knitting machine, and in particular to increase the fineness of the knitting machine (e.g. up to values of 60, 90 or above). In addition, the present invention enables to reduce or eliminate the breaking of the butts of the needles cooperating with the stitch cams. Moreover, the present invention enables to reduce or eliminate the breaking of the yarns, in particular with high finenesses. Furthermore, the present invention enables to reduce failures or malfunctions of a circular knitting machines and/or ensures a higher efficiency in time. Moreover, the needle-holding element of the present invention is characterized by a competitive cost and by a simple and rational structure.

The invention claimed is:

1. A needle-holding element for circular knitting machines, the needle-holding element (i) being configured to be turnably mounted to a frame of a circular knitting machine, (ii) being shaped as a hollow solid of revolution developing around a central axis, (iii) turning around the central axis, (iv) supporting a plurality of needles moving so as to produce a knitted fabric, and (v) comprising:

at least one working surface shaped as a surface of revolution obtained through revolution, around the central axis, of a portion of a generating straight line, wherein on the working surface is defined a plurality of needle seats placed one beside the other and arranged circumferentially around the central axis, each of the plurality of needle seats being configured to movably house at least a portion of at least one respective needle of the knitting machine, wherein at least one needle seat of the plurality of needle seats has at least a first length that has a longitudinal development, on the working surface, inclined with respect to the generating straight line.

2. The needle-holding element according to claim 1, wherein the generating straight line is parallel to the central axis and the portion of the generating straight line is a segment.

3. The needle-holding element according to claim 1, wherein the first length is configured to completely house at least one respective needle in at least one operating position, the first length defining an entirety of the longitudinal development of the corresponding needle seat.

4. The needle-holding element according to claim 3, wherein the needle seat comprises only one rectilinear length having only one inclination angle different from zero with respect to the generating straight line, the only one rectilinear length being coincident with the first length.

5. The needle-holding element according to claim 1, wherein the needle-holding element is a needle-holding cylinder developing as a solid of revolution around the central axis, the generating straight line being parallel to the central axis and the operating surface being an outer surface of the needle-holding cylinder lying on planes parallel to the central axis, wherein the first length is inclined with respect to the generating straight line.

6. A circular knitting machine for knitted or hosiery items, comprising:

a frame;

at least one needle-holding element according to claim 1;

a plurality of needles movably introduced into the plurality of needle seats of the needle-holding element and moving so as to produce a knitted fabric, wherein each of the plurality of needle seats houses at least one respective needle comprising at least one respective butt and one respective head; and a plurality of stitch cams configured to interact with the plurality of needles so as to transmit to each of the plurality of needles a given movement inside the respective needle seats during the rotation of the needle-holding element, wherein each of the plurality of needles extends between (i) an upper portion on which the needle head is defined, configured to interact with the yarns so as to produce the knitted fabric, and (ii) a lower portion on which the needle butt is defined, configured to interact with the stitch cams, each of the plurality of needles having a unitary shape in which the respective head and the respective butt are connected continuously and move integrally inside the respective needle seat, and wherein each needle is configured to slide with an alternate motion inside the respective needle seat, following the main longitudinal development of the respective needle seat.

7. The circular knitting machine according to claim 6, wherein the needle-holding element is a needle-holding cylinder, developing as a solid of revolution around the central axis, the generating straight line being parallel to the central axis and the operating surface being an outer surface of the needle-holding cylinder lying on planes parallel to the central axis, the plurality of needles being configured to slide alternately and vertically inside the respective needle seats.

8. The circular knitting machine according to claim 6, wherein each of the plurality of stitch cams comprises a respective cam path configured to intercept the butts of the needles in rotation with the needle-holding element, so that the needle butts enter the cam path and are guided according to a given law of motion so as to make a given sliding movement inside the respective needle seat, wherein each of the plurality of stitch cams interacts in sequence with the plurality of needles in rotation with the needle-holding element so as to transmit in sequence the same movement to all the needles in the respective needle seat, wherein each needle makes the movement with a given delay, and the cam path of each of the plurality of stitch cams extends over its length from an inlet section at which the needles in rotation enter the cam path to an outlet section at which the needles in rotation get out of the cam path, and wherein the cam path of each of the plurality of stitch cams has for each point over its length a given height size corresponding to a given needle position inside the respective needle seat and the development of the height sizes for each point of the cam path along its length defines the given law of motion of the sliding movement of each of the plurality of needles in the respective needle seat.

9. The circular knitting machine according to claim 8, wherein the cam path comprises, in sequence from the inlet section to the outlet section:

a first rising portion causing a movement of each of the plurality of needles towards the first open end of the respective needle seat so as to take the needle head out and reach a first position in which the knitted loop previously formed is cast off onto a stem;

a second sinking portion causing a movement of each needle back into the respective needle seat so as to reach a second position in which the head, after picking up the yarn, sinks below the holding-down plane so as to form new knitted fabric; and a third outlet portion comprising:

a sinking length going farther in a continuous manner from the second sinking portion beyond the second position and ending up in a lower limit of the cam path corresponding to the lower position taken by the needle butts in the stitch cam, wherein positions of the needle head below the holding-down plane correspond to the sinking length; and a rising length going farther in a continuous manner from the sinking length beyond the lower limit and ending up at the outlet section.

10. The circular knitting machine according to claim 8, wherein, after defining an angle of pressure corresponding to an angle formed for each point of the cam path by a direction of motion of the needle butt perpendicular to the portion of needle seat housing the butt with a point slope of the cam path, the inclination of the first length of the needle seat is configured to cause a reduction of the angle of pressure of a value equal to the angle of inclination of the first length with respect to a condition in which, the slope of the cam path being the same, the angle of inclination is zero.

11. The needle-holding element according to claim 1, wherein each of the plurality of needle seats has a main longitudinal development and is configured to contain laterally inside, and at least partially, the at least one respective needle so that the needle is slidably movable in the needle seat following the longitudinal development of the seat, and the first length is configured to slidably house at least a portion of a respective needle that comprises the butt of the respective needle.

12. The needle-holding element according to claim 1, wherein the first length of the needle seat, corresponding to an entirety of the needle seat, is rectilinear and develops in a respective unitary direction of development which is transverse with respect to the generating straight line and lies on the operating surface.

13. The needle-holding element according to claim 12, wherein the respective unitary direction of development forms with the generating straight line an inclination angle different from zero.

14. The needle-holding element according to claim 4, wherein the inclination angle is calculated as the smallest angle formed by the straight line coinciding to a unitary direction of development of the needle seat together with the generating straight line.

15. The needle-holding element according to claim 4, wherein the plurality of needle seats comprises identical needle seats all having the same respective inclination angle.

16. The circular knitting machine according to claim 8, wherein each point of the cam path has a respective slope corresponding to the angle complementary to the smallest angle formed by a straight line tangent to the point of the path with a straight line passing through the point and oriented like the generating straight line, and wherein at least a portion of the cam path comprises points having a slope above 50°.

17. The circular knitting machine according to claim 9, wherein at least the sinking length of the third outlet portion of the cam path has points with a slope above 50°.

18. The circular knitting machine according to claim 8, wherein when a slope of the cam path is equal to an alpha angle and an angle of inclination of the first length of the needle seat is equal to a beta angle, the angle of pressure equals alpha minus beta.

* * * * *